US007690234B2

(12) United States Patent
Mori et al.

(10) Patent No.: US 7,690,234 B2
(45) Date of Patent: Apr. 6, 2010

(54) TIP TOOL GUIDE APPARATUS AND METHOD FOR BRINGING IN TIP TOOL GUIDE APPARATUS

(75) Inventors: Norimasa Mori, Kobe (JP); Hironori Onitsuka, Kobe (JP); Jun Fujita, Kobe (JP); Takahiro Ohta, Takasago (JP); Yasumi Nagura, Kobe (JP); Yoshimasa Tukamoto, Kobe (JP); Osafumi Nakajima, Kobe (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 230 days.

(21) Appl. No.: 11/774,982

(22) Filed: Jul. 9, 2007

(65) Prior Publication Data

US 2008/0223106 A1 Sep. 18, 2008

(51) Int. Cl.
*C21D 7/06* (2006.01)

(52) U.S. Cl. ..... 72/53; 376/305

(58) Field of Classification Search ..... 72/53; 29/90.01, 90.7; 376/260, 262, 263, 305, 376/310; 134/8, 22.1, 24, 167 R, 167 C, 134/187, 191, 194; 414/744.2, 744.3
See application file for complete search history.

(56) References Cited

U.S. PATENT DOCUMENTS

| | | | | |
|---|---|---|---|---|
| 4,219,976 | A * | 9/1980 | Burack et al. | 451/38 |
| 4,521,844 | A * | 6/1985 | Sturges et al. | 700/69 |
| 4,595,419 | A * | 6/1986 | Patenaude | 134/1 |
| 4,616,496 | A * | 10/1986 | Hawkins | 72/53 |
| 4,635,456 | A | 1/1987 | Harman et al. | |
| 5,107,631 | A * | 4/1992 | Wern | 451/28 |
| 5,107,879 | A * | 4/1992 | Harvey | 134/167 R |
| 5,797,290 | A | 8/1998 | Blissell et al. | |
| 6,240,155 | B1 * | 5/2001 | Kurosawa et al. | 376/305 |
| 6,820,575 | B2 * | 11/2004 | Ashton et al. | 122/379 |

FOREIGN PATENT DOCUMENTS

| | | | |
|---|---|---|---|
| GB | 2 159 085 | A | 11/1985 |
| JP | 6-39718 | A | 2/1994 |
| JP | 2004-149843 | A | 5/2004 |
| JP | 2004-169100 | A | 6/2004 |
| JP | 2006-346775 | A | 12/2006 |
| SU | 691289 | * | 10/1979 |

* cited by examiner

*Primary Examiner*—Edward Tolan
(74) *Attorney, Agent, or Firm*—Westerman, Hattori, Daniels & Adrian, LLP

(57) ABSTRACT

A tip tool guide apparatus is brought into a water chamber of a steam generator of nuclear power equipment, and guides a tip tool, such as a shot peening head, along a necessary region. For this purpose, a tip tool guide apparatus 1000 is composed of a swivel support portion 100, a slide table 200, and a manipulator 300. The swivel support portion 100 is self-supported and fixed within the water chamber, and turns the slide table 200 connected thereto. The slide table 200 connects the manipulator 300, and moves the manipulator 300 slidingly in a fore-and-aft direction. The manipulator 300 grasps the tip tool at its leading end. For bringing into the water chamber, the swivel support portion 100, the slide table 200, and the manipulator 300 are separated from each other, brought in individually, and assembled within the water chamber to constitute the tip tool guide apparatus 1000.

2 Claims, 37 Drawing Sheets

Fig. 21 (b)
Fig. 21 (a)
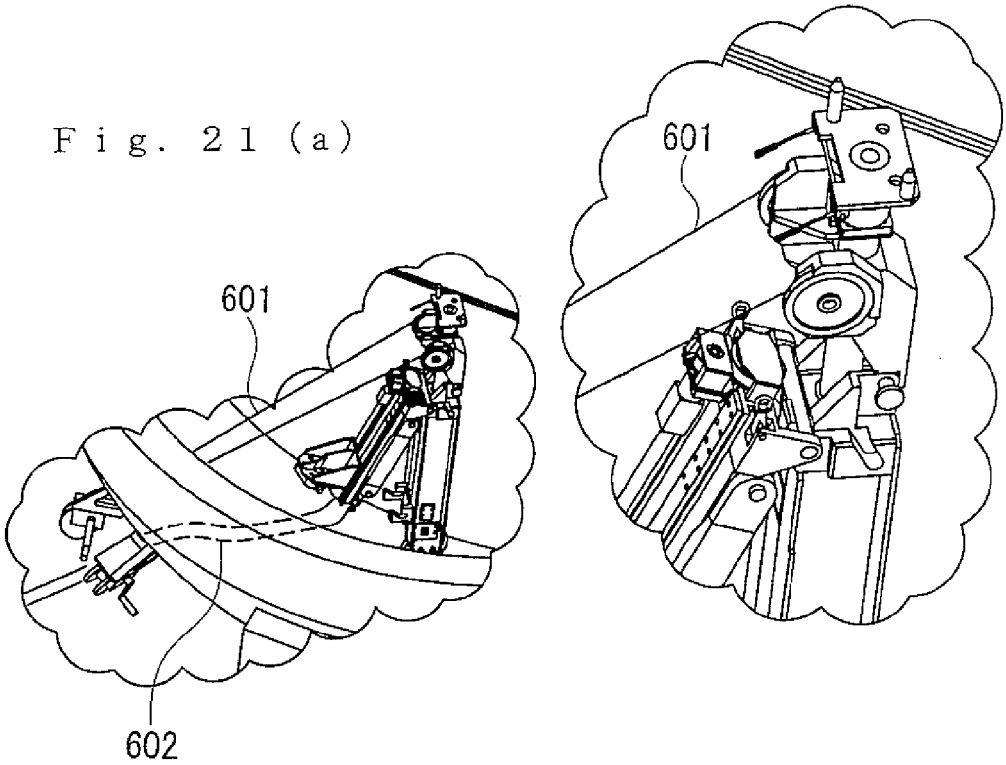
Fig. 22
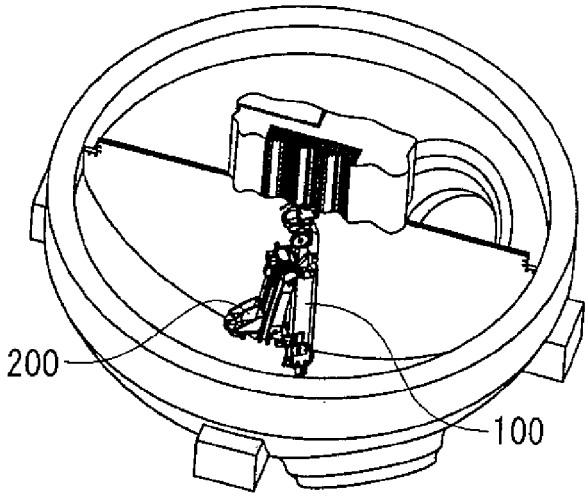

TIP TOOL GUIDE APPARATUS AND METHOD FOR BRINGING IN TIP TOOL GUIDE APPARATUS

BACKGROUND OF THE INVENTION

1. Field of the Invention

This invention relates to a tip tool guide apparatus, and a method for bringing in the tip tool guide apparatus.

The tip tool guide apparatus of the present invention is an apparatus which is brought into a water chamber of a steam generator of nuclear power equipment, and guides various tip tools, necessary to perform shot peening, along a necessary processing region.

The method for bringing in the tip tool guide apparatus according to the present invention is a method for efficiently bringing the tip tools into and out of the water chamber of the steam generator of nuclear power equipment via a manhole formed in the water chamber.

2. Description of the Related Art

FIG. 39 shows a primary system of pressurized light water reactor nuclear power equipment. As shown in this drawing, a reactor vessel 1, a pressurizer 2, a steam generator 3, and a pump 4 are sequentially connected by a main coolant pipe 5 to form a primary circulating path. In this primary circulating path, a main coolant (primary water) 6 pressure-fed by the pump 4 flows in a circulating manner.

The primary water 6 at a high temperature and a high pressure, which has been heated in the reactor vessel 1, is supplied to the steam generator 3 through the main coolant pipe 5 while being maintained at a constant pressure by the pressurizer 2. This primary water 6 enters an inlet-side water chamber 3*b* from an inlet pipe nozzle stub 3*a* of the steam generator 3, further flows through many inverted-U-shaped heat transfer tubes 3*c*, enters an outlet-side water chamber 3*d*, and exits from an outlet pipe nozzle stub 3*e*.

On this occasion, secondary water 10 returned from a turbine is heated and evaporated by a group of the heat transfer tubes 3*c*, within which the high temperature primary water 6 flows. Steam 11 thus generated is separated upon steam-water separation by a steam separator 12, and supplied to the turbine (not shown) to drive the turbine. This driving of the turbine rotationally drives a generator (not shown) to generate electric power.

A lower portion of the steam generator 3 is shown enlarged in FIG. 40. As shown in FIG. 40, the inlet-side water chamber 3*b* and the outlet-side water chamber 3*d* are separated from each other by a partition plate 3*f*. The inlet pipe nozzle stub 3*a* is installed in a downwardly inclined posture when viewed from the inlet-side water chamber 3*b*, while the outlet pipe nozzle stub 3*e* is installed in a downwardly inclined posture when viewed from the outlet-side water chamber 3*d*.

FIG. 41 shows a welded joint structure for welding between the nozzle stub 3*e* (3*a*) and the main coolant pipe 5. The nozzle stub 3*e* (3*a*) is formed from a material which is carbon steel or low alloy steel. The interior of the nozzle stub 3*e* (3*a*) has been subjected to build-up welding with stainless steel 30, and a buttering portion 31 of a nickel-chromium-iron alloy (600-alloy) is applied to an end portion of the nozzle stub 3*e* (3*a*).

A safe end 32 formed from stainless steel is welded to the buttering portion 31 with the use of a weld zone 33 of 600-alloy. The main coolant pipe 5 is welded to the other end of the safe end 32 with the use of a welding material 34 of stainless steel.

The 600-alloy material, as a nickel-chromium-iron alloy, in the pressurized light water reactor nuclear power equipment may undergo stress-corrosion cracking as the equipment is very aged, if high stress occurs in the presence of primary water at a high temperature.

Residual stress has been generated in the 600-alloy buttering portion 31 and the 600-alloy weld zone 33 because of welding during manufacture. To suppress the stress-corrosion cracking of the 600-alloy buttering portion 31 and the 600-alloy weld zone 33 contacting the primary water, it is effective to decrease the residual stress generated in the 600-alloy buttering portion 31 and the 600-alloy weld zone 33.

In the existing nuclear power equipment, therefore, it has been considered an effective method to withdraw the main coolant (primary water) 6, and perform shot peening of the surfaces of the 600-alloy buttering portion 31 and the 600-alloy weld zone 33 (their inner peripheral surfaces) from the inner peripheral surface side of the nozzle stubs 3*a*, 3*e*, thereby decreasing the residual stress of this region. FIG. 42 shows a peening width W of a processing region which is subjected to shot peening. Japanese Unexamined Patent Publication No. 2004-169100 is available as a document showing an earlier technology.

However, the shot peening performed from the inner peripheral surface side of the inlet pipe nozzle stub 3*a* and the outlet pipe nozzle stub 3*e* posed the following problems:

(1) With the existing nuclear power equipment, the dose rates within the water chambers 3*b* and 3*d* are extremely high. To ensure safety, therefore, the time for which an operator stays within the water chamber 3*b* or 3*d* needs to be limited to a minimum required time.

(2) As shown in FIG. 43 which is a sectional view taken along line X-X in FIG. 40, a manhole H of a small diameter (about 400 mm) is formed in the outlet-side water chamber 3*d*. Similarly, a manhole H of a small diameter is formed in the inlet-side water chamber 3*b*. To enter the water chamber 3*b* or 3*d* and apply shot peening to the inner peripheral surface of the nozzle stub 3*a* or 3*e*, this narrow manhole H is the only passage leading to the water chamber 3*b* or 3*d*.

Thus, an apparatus brought into the water chamber 3*b* or 3*d* for the shot peening operation needs to be a compact and lightweight one of a shape allowing passage through the manhole H.

The apparatus also needs to be contrived such that it can be easily brought into the water chamber 3*b* or 3*d*.

(3) It is also necessary that the shot peening operation can be performed accurately and promptly.

It is true that if shot peening of the inlet pipe nozzle stub 3*a* and the outlet pipe nozzle stub 3*e* can be performed from the inner peripheral surface side thereof, the stress-corrosion cracking of the 600-alloy buttering portion 31 and the 600-alloy weld zone 33 can be suppressed. However, there has been no concrete instrument which can apply shot peening accurately and promptly while solving the above-mentioned problems.

SUMMARY OF THE INVENTION

The present invention has been accomplished in light of the above-described earlier technology. It is an object of the invention to provide a tip tool guide apparatus, and a method for bringing in the tip tool guide apparatus, which are used when performing shot peening of a nozzle stub from an inner peripheral surface side thereof, the nozzle stub being connected to a water chamber of a steam generator provided in nuclear power equipment.

A tip tool guide apparatus according to the present invention, for solving the above problems, is a tip tool guide apparatus which is brought into a water chamber of a steam generator of nuclear power equipment, and guides various tip tools, necessary to perform shot peening, along a processing region for shot peening, the tip tool guide apparatus comprising a manipulator fixing portion and a manipulator, the manipulator fixing portion having a structure which can guide the manipulator to an appropriate place within the water chamber and fix the manipulator, the manipulator fixing portion further having a structure for supporting a proximal end portion of the manipulator detachably, and the manipulator having at a leading end thereof a tool changer for supporting the tip tool detachably.

Also, a tip tool guide apparatus according to the present invention is a tip tool guide apparatus which is brought into a water chamber of a steam generator of nuclear power equipment, and guides various tip tools, necessary to perform shot peening, along a processing region for shot peening, the tip tool guide apparatus comprising a swivel support portion, a slide table and a manipulator, the swivel support portion including a lower base which is to become a portion landing on a bottom surface of the water chamber, a swivel portion mounted swingably on the lower base so as to be capable of swiveling in a horizontal plane when standing in a vertical direction, an upper support portion which is provided to be movable upward and downward with respect to the lower base and abuts on a ceiling surface of the water chamber when ascending, and an elevating mechanism for raising and lowering the upper support portion, the slide table including a table portion, connecting means for connecting the table portion to the swivel portion detachably, and a slide portion which moves slidingly with respect to the table portion and supports a proximal end portion of the manipulator detachably, and the manipulator having at a leading end thereof a tool changer for supporting the tip tool detachably.

A method for bringing in a tip tool guide apparatus according to the present invention is a method for bringing in a tip tool guide apparatus, which brings the tip tool guide apparatus according to claim 2 into a water chamber of the steam generator via a manhole formed in the water chamber, the method comprising the steps of:

disposing a sheave, over which a wire is passed, within the water chamber, connecting one end side of the wire to the swivel support portion, withdrawing other end side of the wire out of the water chamber through the manhole, and pulling the wire outside the water chamber to bring the swivel support portion into the water chamber through the manhole;

landing the lower base of the swivel support portion, which has been brought into the water chamber, on a bottom surface of the water chamber, and pressing the upper support portion against a ceiling surface of the water chamber to render the swivel support portion self-supported;

disposing a sheave, over which a wire is passed, within the water chamber, connecting one end side of the wire to the slide table, withdrawing other end side of the wire out of the water chamber through the manhole, pulling the wire outside the water chamber to bring the slide table into the water chamber through the manhole, and connecting the slide table, which has been brought into the water chamber, to the swivel support portion via the connecting means;

turning the swivel portion of the swivel support portion, thereby causing the slide portion of the slide table to face the manhole; and inserting the manipulator into the water chamber via the manhole, with a proximal end portion of the manipulator being at a forefront, and connecting the proximal end portion of the manipulator to the slide portion.

According to the present invention, the tip tool guide apparatus is constituted by the swivel support portion, the slide table, and the manipulator, which can be disassembled and assembled. Thus, the respective instrument portions in a disassembled state are brought into the water chamber through the narrow manhole formed in the water chamber, and the tip tool guide apparatus can be assembled within the water chamber. Thus, the tip tool guide apparatus can be easily brought in to and brought out of the water chamber.

In addition, shot peening can be performed accurately and promptly using the tip tool guide apparatus assembled and installed within the water chamber. During this processing, the operator can retreat out of the water chamber, and safety can be ensured.

BRIEF DESCRIPTION OF THE DRAWINGS

FIGS. 21(*a*) and 21(*b*) are explanation drawings showing the method for bringing the slide table into the water chamber.

FIG. 22 is an explanation drawing showing the method for bringing the slide table into the water chamber.

DESCRIPTION OF THE PREFERRED EMBODIMENTS

The best mode for carrying out the present invention will be described in detail based on embodiments.

Embodiment 1

Figure 1:
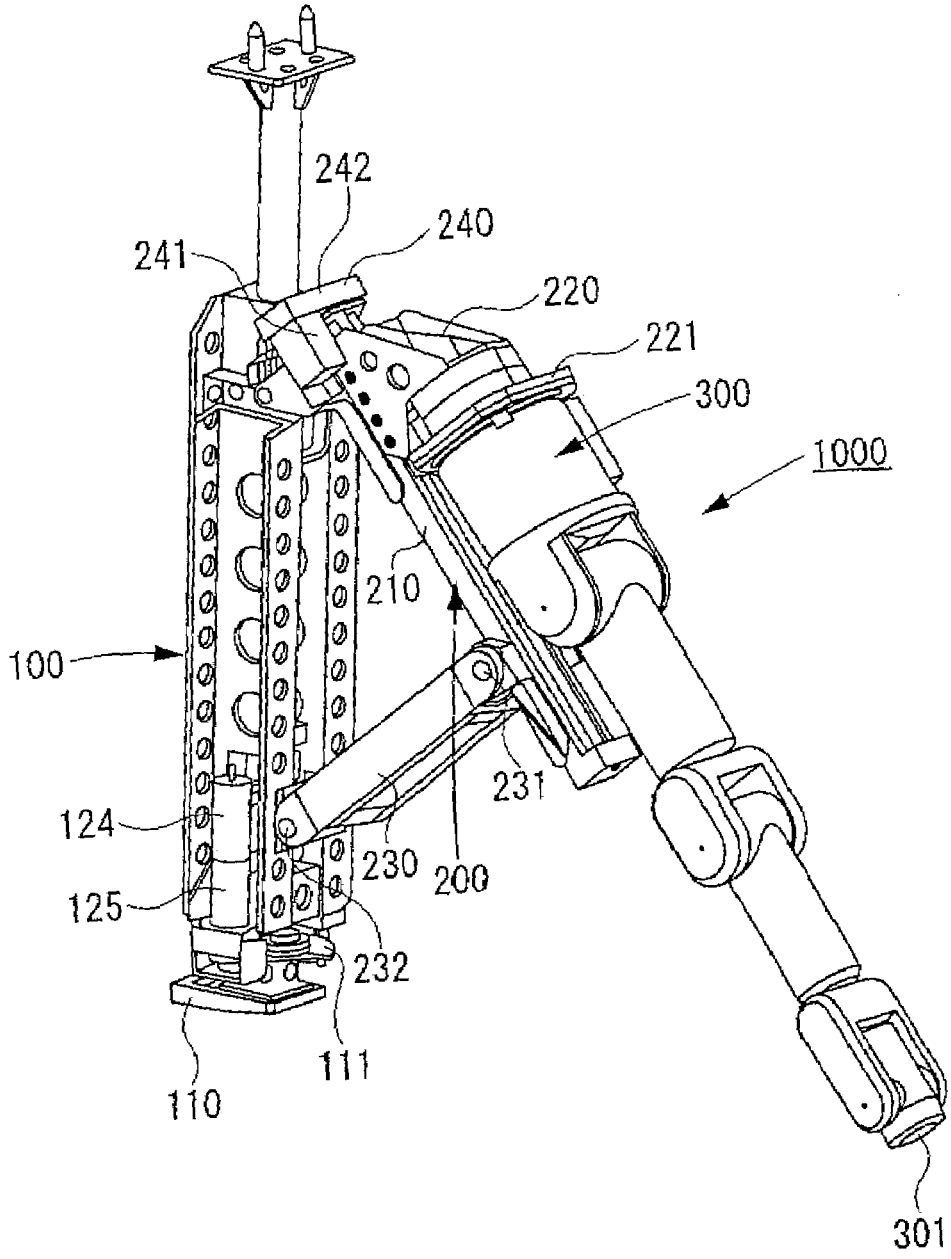
FIG. 1 is a perspective view showing a tip tool guide apparatus according to an embodiment of the present invention.
Figure 2:
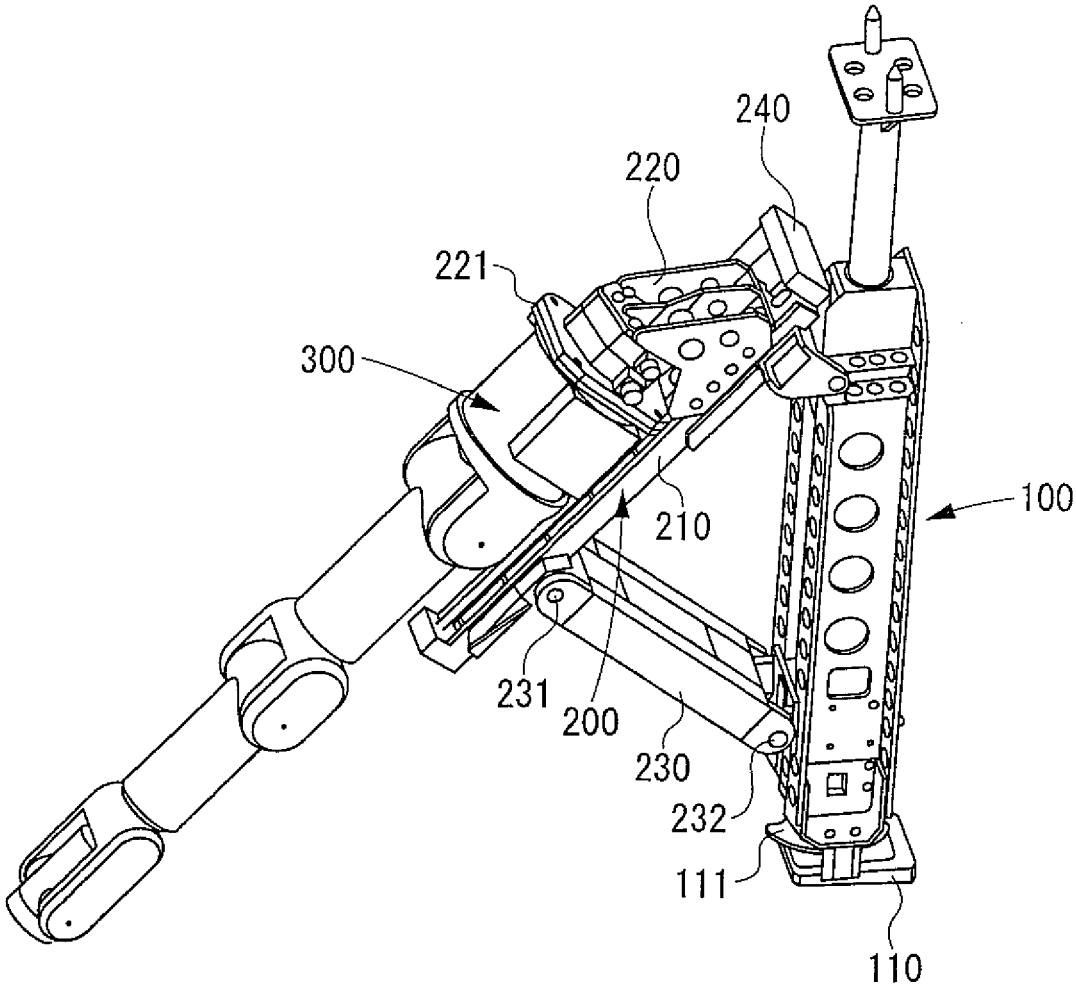
FIG. 2 is a perspective view showing the tip tool guide apparatus according to the embodiment of the present invention.
Figure 3:
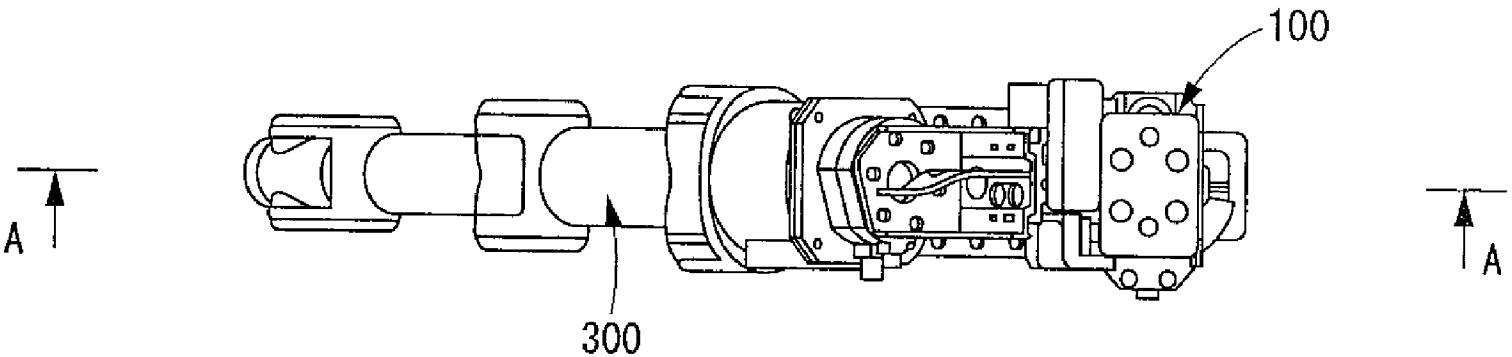
FIG. 3 is a plan view showing the tip tool guide apparatus according to the embodiment of the present invention.
Figure 4:
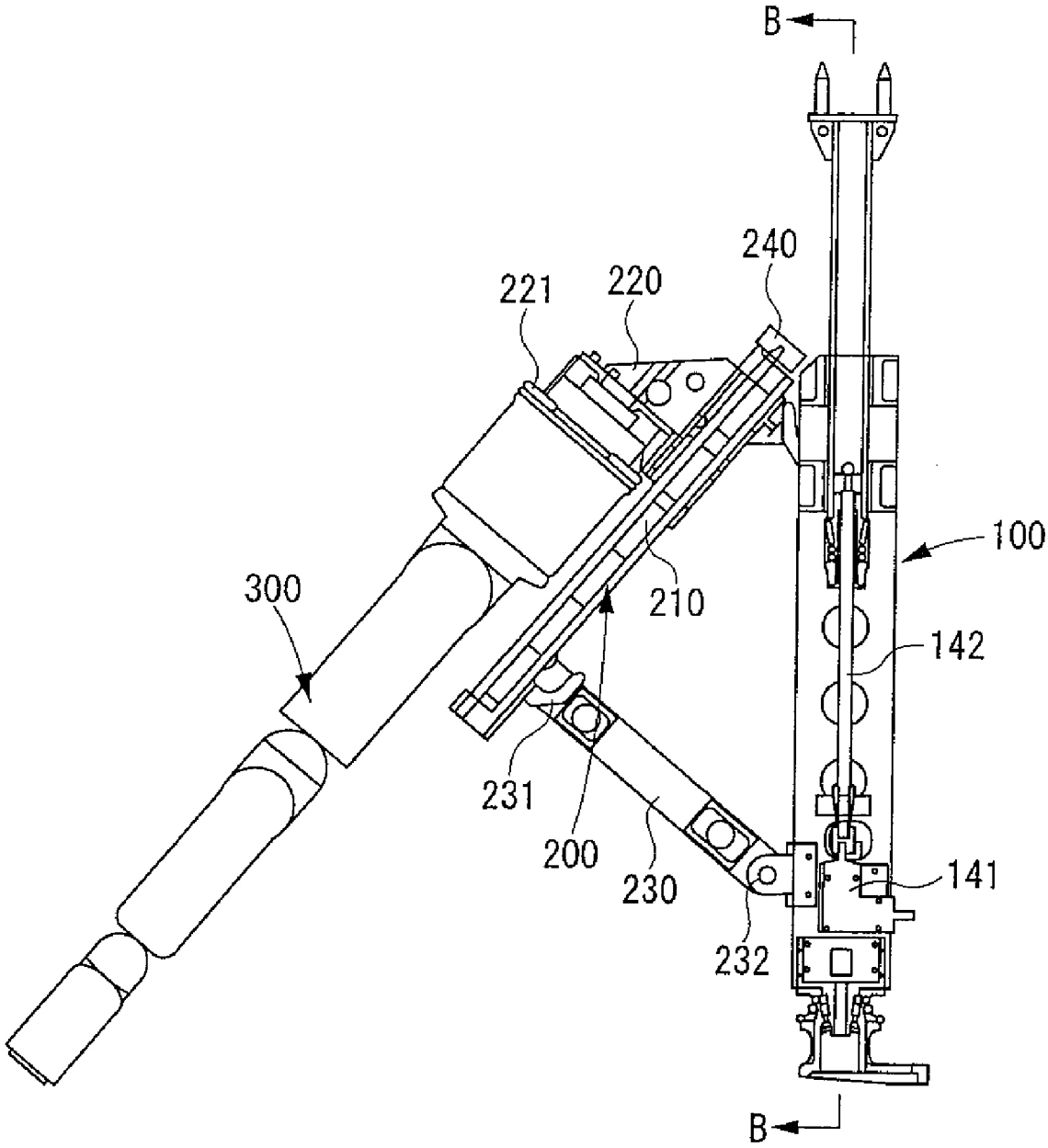
FIG. 4 is a configurational drawing showing a section along line A-A in FIG. 3.

A tip tool guide apparatus 1000 according to Embodiment 1 of the present invention will be described with reference to FIGS. 1 and 2 which are perspective views, FIG. 3 which is a plan view, and FIG. 4 which is a sectional view taken along line A-A in FIG. 3.

The tip tool guide apparatus 1000 is composed of a swivel support portion 100, a slide table 200, and a manipulator 300 as main members. FIGS. 1 to 4 show a state in which the swivel support portion 100, the slide table 200, and the manipulator 300 are combined to constitute the tip tool guide apparatus 1000.

However, when this tip tool guide apparatus 1000 is to be brought into a water chamber of a steam generator, the swivel support portion 100, the slide table 200, and the manipulator 300 are separated from each other, and individually brought into the water chamber. The swivel support portion 100, the slide table 200, and the manipulator 300, which have been sequentially brought into the water chamber, are connected and combined to assemble the tip tool guide apparatus 1000 within the water chamber. Details of the procedure for bringing-in and assembly will be described later.

Figure 5:
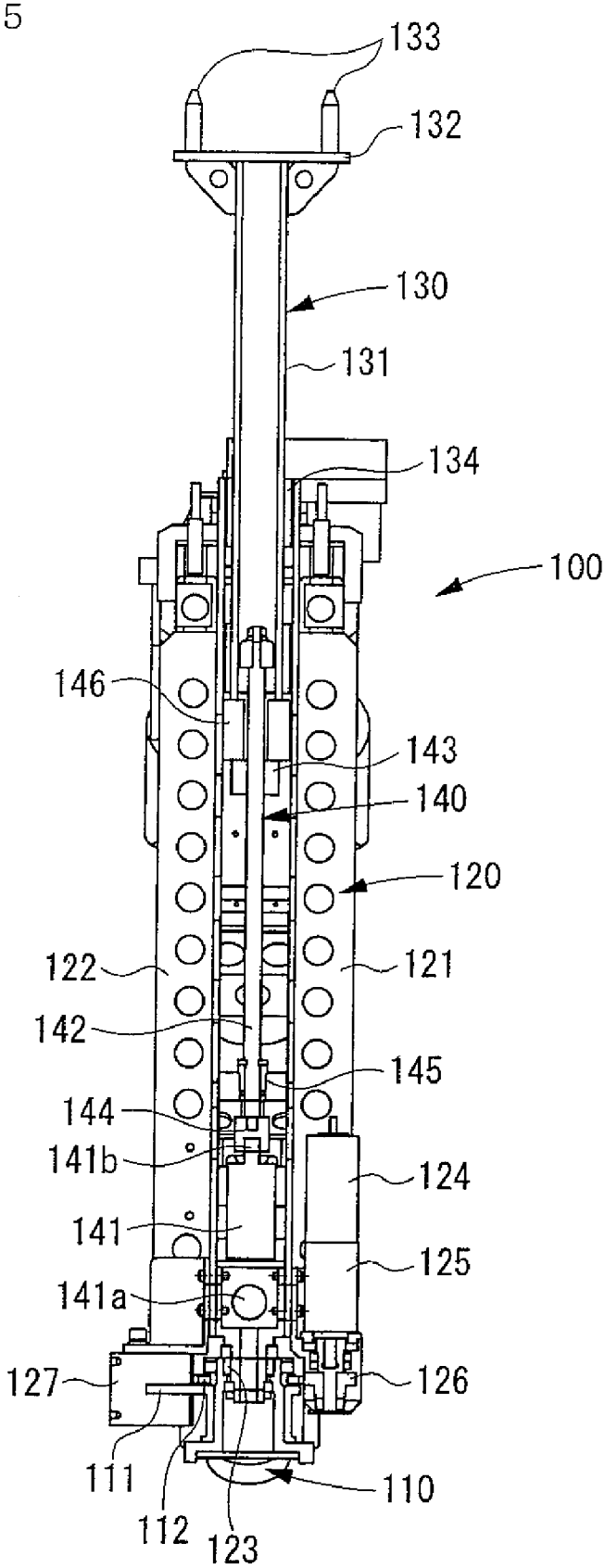
FIG. 5 is a configurational drawing showing a section along line B-B in FIG. 4.

Next, the detailed structure of the swivel support portion 100 will be explained with reference to FIG. 5 which is a sectional view taken along line B-B in FIG. 4.

The swivel support portion 100 is composed of a lower base 110, a swivel portion 120 mounted swingably on the lower base 110, an upper support portion 130 ascendable and descendable with respect to the lower base 110, and an elevating mechanism 140 for raising and lowering the upper support portion 130.

A disk 111 and a swing gear 112 are fixedly installed on the lower base 110. The lower base 110 becomes a portion landing on the bottom surface of the water chamber, when the tip tool guide apparatus 1000 is assembled within the water chamber.

The swivel portion 120 has an erected structure comprising two steel bodies 121 and 122 connected together, each of the steel bodies 121 and 122 having a nearly U-shaped horizontal section. The bottom of the swivel portion 120 is swingably installed on the lower base 110 via a bearing portion 123. Thus, the swivel portion 120 can swivel in a horizontal plane while standing in a vertical direction.

A swivel drive motor 124, a speed reducer 125, and a motor gear 126 are mounted on the swivel portion 120. A rotating force is transmitted from the swivel drive motor 124 to the motor gear 126 via the speed reducer 125, and the motor gear 126 meshes with the swing gear 112.

Hence, when the swivel drive motor 124 is rotationally driven, the motor gear 126 as a pinion rotates on its own axis while meshing with the swing gear 112 as a wheel, thus rotating about the swing gear 112 along the circumferential surface of the swing gear 112. As a result, the entire swivel portion 120 swivels upon driving of the swivel drive motor 124.

The swivel portion 120 is equipped with a disk brake 127, and the disk brake 127 pinches the disk 111 and can thereby regulate the swiveling movement of the swivel portion 120.

The upper support portion 130 has a slide pipe 131, an upper fixing plate 132 disposed on the upper surface of the slide pipe 131, and a pair of engaging pins 133 disposed on the upper surface of the upper fixing plate 132.

The slide pipe 131 is supported by the steel bodies 121 and 122 of the swivel portion 120 via a slide bush 134 to be slidable in a vertical direction. That is, since the slide bush 134 is present, the swiveling force of the swivel portion 120, if swiveling, is not transmitted to the slide pipe 131, and the raising or lowering force of the slide pipe 131, if ascending or descending, is not transmitted to the swivel portion 120. Because of this mechanism, the ascending or descending slide pipe 131 can be held in position by the steel bodies 121 and 122.

As the upper support portion 130 ascends, the upper fixing plate 132 abuts on a portion of the water chamber corresponding to the ceiling surface, and the engaging pins 133 are inserted into the heat transfer tubes. At this time, the whole of the swivel support portion 100 is reliably maintained in an erected state, because the lower base 110 lands on the bottom surface of the water chamber, and the upper support portion 130 is pressed against the ceiling surface of the water chamber.

The elevating mechanism 140 is composed of a bevel gear box 141, a feed screw shaft 142, and a feed nut 143 as main members.

The bevel gear box 141 has bevel gears inside, and has an input portion 141*a* and an output portion 141*b*. A rotating shaft of the input portion 141*a* is disposed in a horizontal direction, while a rotating shaft of the output portion 141*b* is disposed in a vertical direction. The lower end of the feed screw shaft 142 is connected to the output portion 141*b*. Thus, when the rotating shaft of the input portion 141*a* is rotated by an electric drill or the like, the feed screw shaft 142 is rotated.

The feed screw shaft 142 is rotatably supported by the swivel portion 120 via a bearing 145.

The feed nut 143 is screwed to the feed screw shaft 142, and is connected to the lower end of the slide pipe 131 via a connecting portion 146. Moreover, the rotation of the feed nut 143 is regulated by the connecting portion 146. Thus, when the feed screw shaft 142 rotates, the feed nut 143 ascends or descends. In accordance with the ascent or descent of the feed nut 143, the upper support portion 130 ascends or descends.

Figure 6:
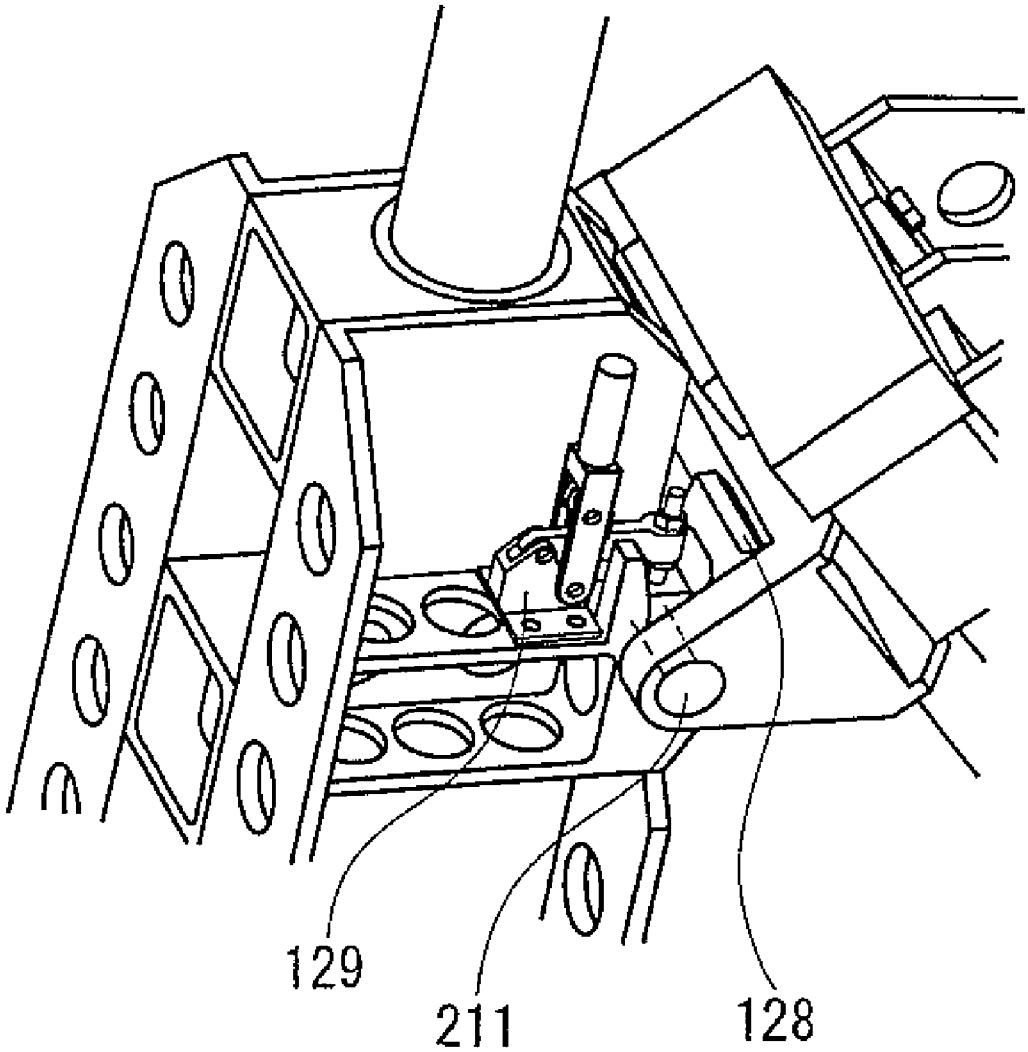
FIG. 6 is a perspective view showing an upper part of a swivel portion.

Furthermore, as shown in FIG. 6 which is a perspective view showing the upper part of the swivel portion 120, an engaging hook 128 is provided in the upper part of the swivel portion 120. An engaging pin 211 of the slide table 200 engages the engaging hook 128. Upon engagement between the engaging hook 128 and the engaging pin 211, a toggle clamp 129 can fix a clamping state.

Next, the detailed structure of the slide table 200 will be described with reference to FIGS. 1, 2, 4 and 5. The slide table 200 is composed of a table portion 210, a slide portion 220, a support portion 230, and a drive portion 240 as main members.

The slide table 200 is connected to the swivel portion 120 of the swivel support portion 100, and swings as the swivel portion 120 swivels. The method of the connection will be described later.

The engaging pin 211 is provided on the proximal end side of the table portion 210 (see FIG. 6). The engaging pin 211 engages the engaging hook 128 of the swivel portion 120, whereby the proximal end side of the table portion 210 is detachably connected to the upper part of the swivel portion 120.

The slide portion 220 can move slidingly along the upper surface of the table portion 210 along the longitudinal direction of the table portion 210. A tool changer 221 for grasping a proximal end portion of the manipulator 300 is provided on the front surface of the slide portion 220. The tool changer 221 grasps the proximal end portion of the manipulator 300, whereby connection between the slide portion 220 and the manipulator 300 takes place.

The support portion 230 has one end side pivotably connected to the leading end side of the table portion 210 by a pivot portion 231. When the slide table 200 is connected to the swivel portion 120, the support portion 230 has the other end side thereof detachably connected to a lower part of the swivel portion 120 by an engaging portion 232.

The drive portion 240 has a motor 241, a speed reducer 242, a feed screw mechanism, etc., and allows the slide portion 220 to slide on the upper surface of the table portion 210.

Next, the manipulator 300 will be described with reference to FIGS. 1, 2 and 4. The manipulator 300 is a seven-axis manipulator, in which a connecting portion for connection to the tool changer 221 of the slide portion 220 is constituted at the proximal end side thereof, and a tool changer 301 for supporting a tip tool detachably is provided on the leading end side thereof. Examples of the tip tool are various tip tools necessary for shot peening, and various detecting sensors for testing the status of a region to be subjected to shot peening.

Figure 7:
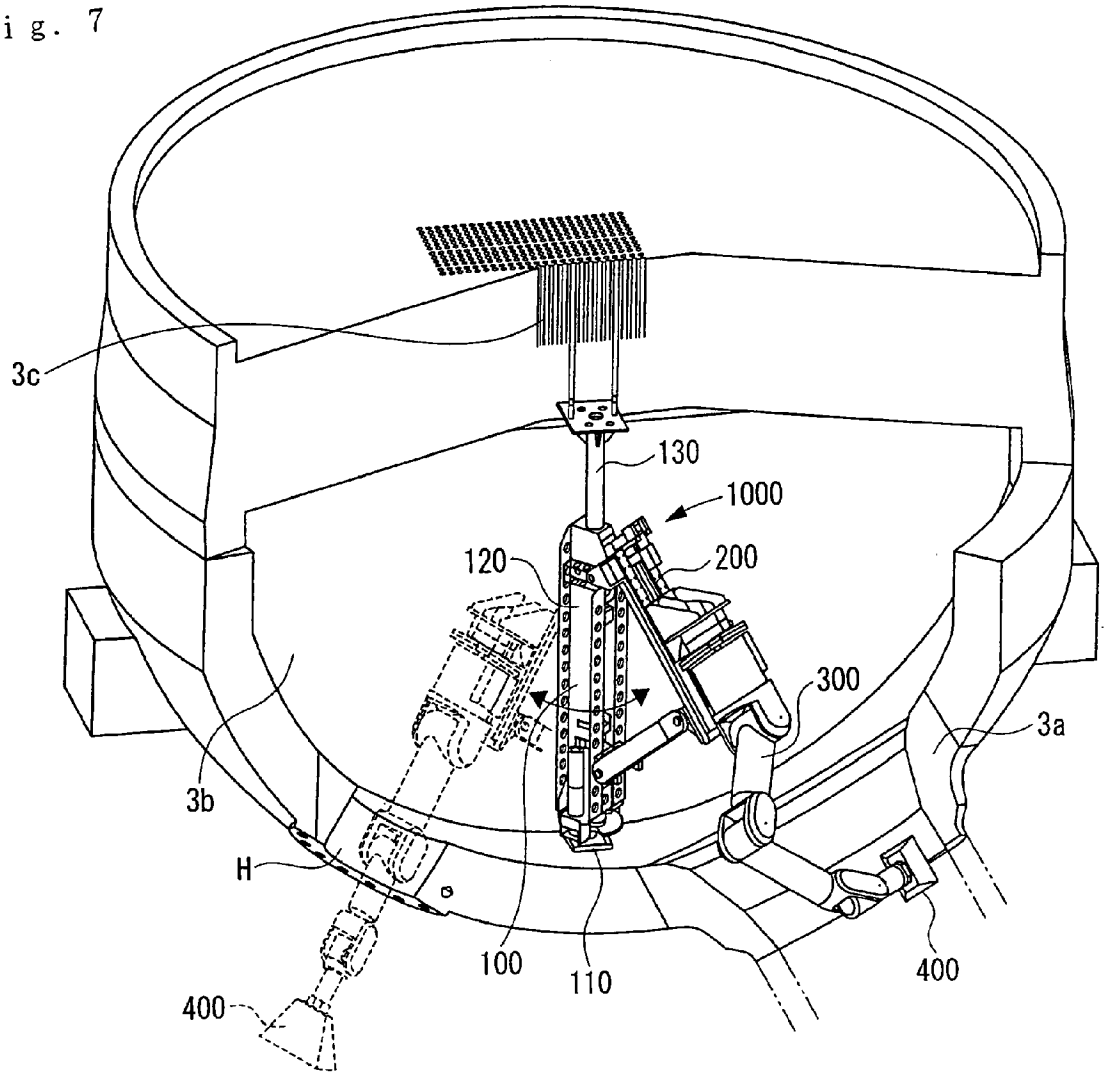
FIG. 7 is a perspective view showing the tip tool guide apparatus according to the embodiment of the present invention.

FIG. 7 shows a state in which shot peening is performed by the tip tool guide apparatus 1000 having the above-described configuration.

The swivel support portion 100, the slide table 200, and the manipulator 300 are brought into the water chamber 3*b* through the manhole H, and these members are connected together within the water chamber 3*b* to assemble the tip tool guide apparatus 1000. The procedures for bringing-in and assembly will be described later.

Then, the lower base 110 of the tip tool guide apparatus 1000 is landed on the bottom surface of the water chamber 3*b*. The elevating mechanism 140 is driven to raise the upper support portion 130, thereby pressing the upper fixing plate 132 against the ceiling surface of the water chamber 3*b* while inserting the engaging pins 133 into the heat transfer tubes 3*c*, with the result that the tip tool guide apparatus 1000 is erected within the water chamber 3*b*. In short, the lower base 110 and the upper support portion 130 establish a vertically straightened-up state in which the tip tool guide apparatus 1000 is erected. When the tip tool guide apparatus 1000 is so erected while straightened up, an electromagnetic brake 144 restrains the feed screw shaft 142 from rotating, thereby preventing the descent of the upper support portion 130.

At this time, the position of erection of the tip tool guide apparatus 1000 is set at a predetermined position (for example, the center of the water chamber 3*b*, namely, the lowermost part of the curved bottom surface).

Supply of electric power, signals, water, air, etc. to the tip tool guide apparatus 1000 is performed by supply cables (not shown).

A control device (not shown) for controlling the actions of the tip tool guide apparatus 1000 is installed outside the water chamber 3*b*. By operating this control device, the tip tool guide apparatus 1000 is actuated.

Concretely, the following actions are performed by operating the control device.

First, the swivel drive motor 124 is driven to turn the swivel portion 120, thereby setting the slide table 200 at a position opposed to the manhole H.

In this state, the slide portion 220 is pushed out forwardly, and the manipulator 300 is actuated to force the leading end of the manipulator 300 out of the manhole H.

In the present embodiment, the seven-axis articulated manipulator is illustrated. However, there are no limitations on the number of the axes (single-axis, multi-axis) and the constitution of the axis (joint axis, linear-motion axis), and it is to be understood that all manipulators, as generally referred to, are included.

A tip tool 400 is attached to the leading end of the manipulator 300 that has exited.

Then, the slide portion 220 is retreated rearward, and the manipulator 300 is operated to retract the tip tool 400 into the water chamber 3*b*.

Further, the swivel drive motor 124 is driven to turn the swivel portion 120, setting the slide table 200 at a position opposed to the inlet pipe nozzle stub 3*a*.

In this state, the slide portion 220 and the manipulator 300 are operated to move (guide) the tip tool 400 along a shot peening region of the inner peripheral surface of the inlet pipe nozzle stub 3*a*. When the tip tool 400 is a detecting sensor, the state of the shot peening region is examined using the tip tool 400. When the tip tool 400 is a shot peening head, shot peening is actually performed using the tip tool 400.

Shot peening is performed by the tip tool guide apparatus 100 assembled within the water chamber 3*b*, as described above. Thus, shot peening can be performed efficiently, and an operator is not exposed to radiation during this treatment, because the operator stays outside the water chamber 3*b*.

While the swing of the swivel portion 120 is being stopped, the disk 111 is pinched by the disk brake 127 to apply a brake, regulating the swing of the swivel portion 120.

As the tip tool 400, a distance detecting sensor is used initially to detect the distance between each point in the shot peening region (the region extending along the circumferential direction) and the leading end position of the manipulator 300. By so doing, the exact position of installation of the manipulator 300 with respect to the shot peening region can be recognized.

By thus recognizing the exact position of the manipulator 300, a guide path (tracing position) is corrected in consideration of the position of the manipulator 300, when the tip tool 400, such as a shot peening head, is guided along the shot peening region. By this measure, the tip tool 400, such as a shot peening head, can be reliably guided accurately along the shot peening region.

Examination of the shot peening region is made before and after shot peening.

In connection with replacement of the tip tool 400, the leading end of the manipulator 300 is brought out of the manhole H, and necessary mounting and dismounting of the tip tool 400 are carried out for the tool changer 301 located at the leading end of the manipulator 300 exiting out of the manhole H. Since tool replacement is thus carried out outside the water chamber 3*b*, therefore, tool replacement can be performed efficiently, and the operator is not exposed to a high dose of radiation during tool replacement.

Upon completion of the necessary operation, the connection among the swivel support portion 100, the slide table 200, and the manipulator 300 is released, and the swivel support portion 100, the slide table 200, and the manipulator 300 are individually brought out of the water chamber 3*b* through the manhole H.

In the other water chamber 3*d* as well, an operation is performed by the same procedure, whereby shot peening can be achieved.

During assembly of the tip tool guide apparatus 1000, the operator enters the water chamber. At this time, the operator wears a protective suit (a suit cut off from the outside and ensuring airtightness so that the operator does not take a substance having radioactivity by suction or the like into the body). Moreover, the operator enters the water chamber only when assembling the tip tool guide apparatus 1000, for example. Thus, safety is enhanced.

Embodiment 2

Next, the procedure for bringing the above-described tip tool guide apparatus 1000 into the water chamber will be explained as Embodiment 2.

Figure 8:
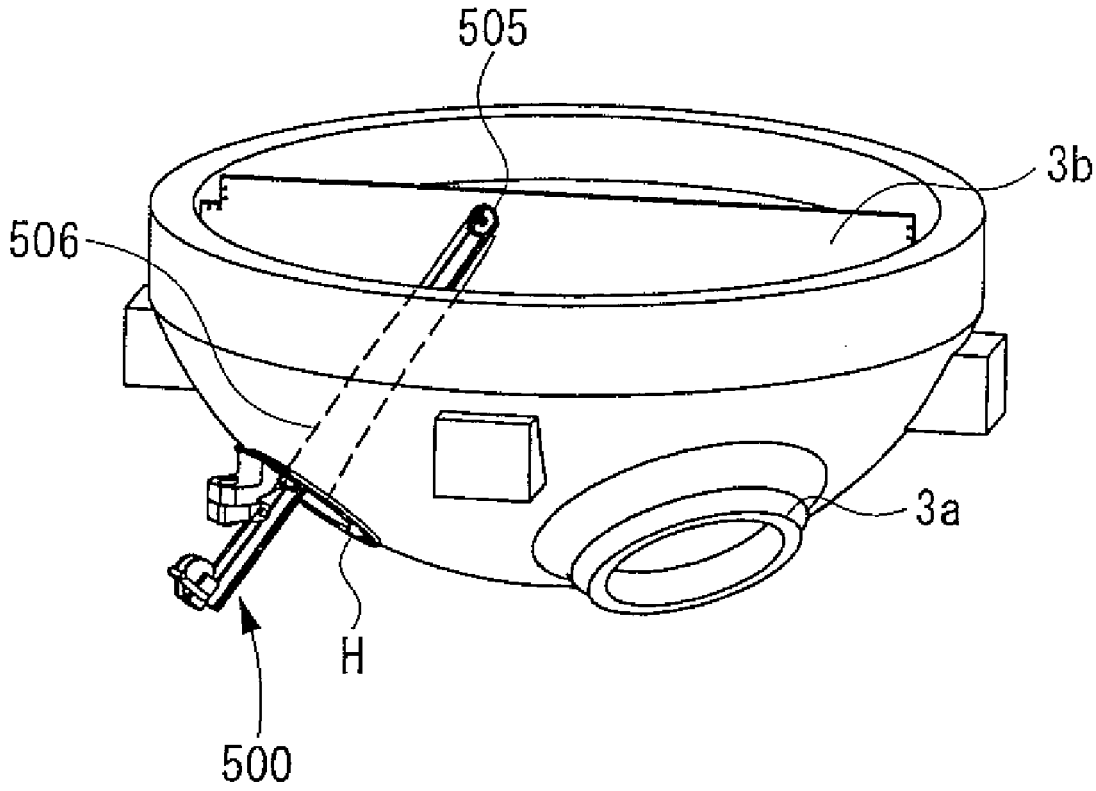
FIG. 8 is an explanation drawing showing a method for bringing a swivel support portion into a water chamber.
Figure 9:
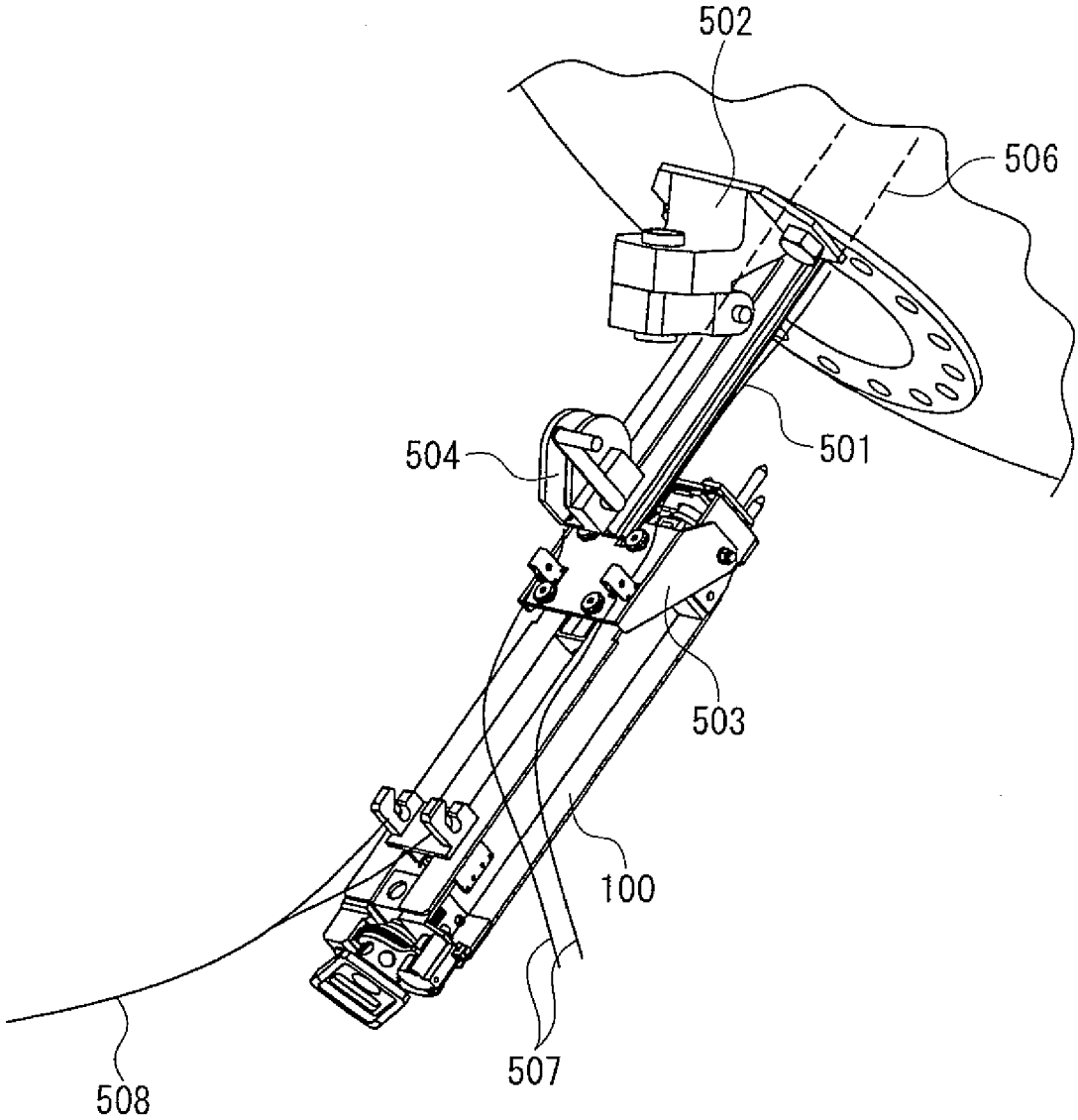
FIG. 9 is an explanation drawing showing the method for bringing the swivel support portion into the water chamber.

As shown in FIGS. 8 and 9, a carry-in rail device 500 is attached to the manhole H. The carry-in rail device 500 includes a rail 501, a pan/tilt mechanism 502, a trolley 503, a windup winch 504, a sheave 505, and a wire 506.

The pan/tilt mechanism 502 is fixed to the manhole H, and supports the rail 501 to be capable of panning (in a right-and-left direction) and tilting (in an up-and-down direction). The rail 501 is inserted from outside the water chamber 3*b* into the interior of the water chamber 3*b* obliquely upwardly.

The trolley 503 can move along the rail 501, and holds an upper part of the swivel support portion 100 in a pinned state. The wire 506 is paid off from the windup winch 504, passed over the sheave 505 installed at the leading end of the rail 501, then reversed, and connected to the trolley 503.

A wire 507 is tied to an upper part of the swivel support portion 100, and a wire 508 is tied to a lower part of the swivel support portion 100.

Figure 10:
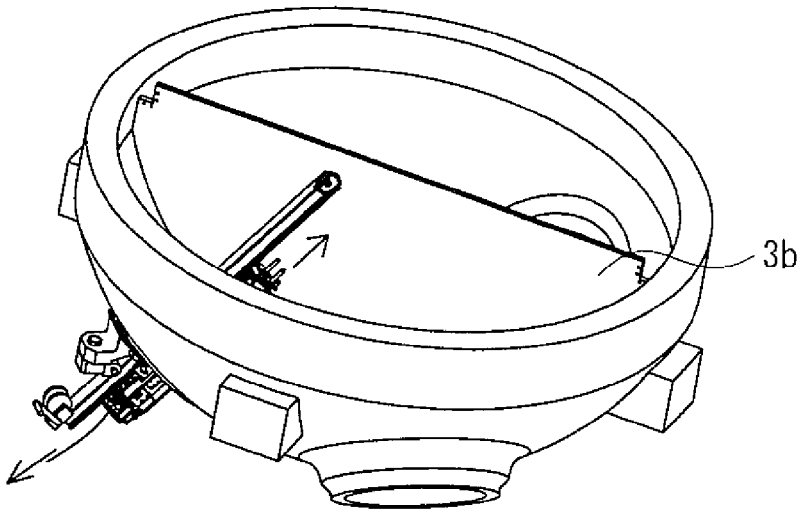
FIG. 10 is an explanation drawing showing the method for bringing the swivel support portion into the water chamber.
Figure 11:
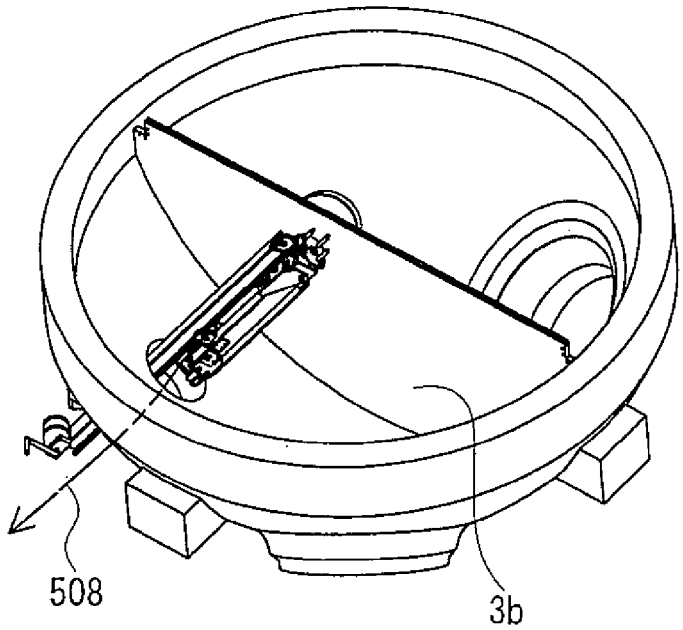
FIG. 11 is an explanation drawing showing the method for bringing the swivel support portion into the water chamber.

When the wire 506 is taken up by the windup winch 504, the trolley 503 holding the swivel support portion 100 moves along the rail 501, and enters the water chamber 3*b*, as shown in FIGS. 10 and 11. At this time, back tension is applied by the wire 508 to keep the swivel support portion 100 along the rail 501.

Figure 12:
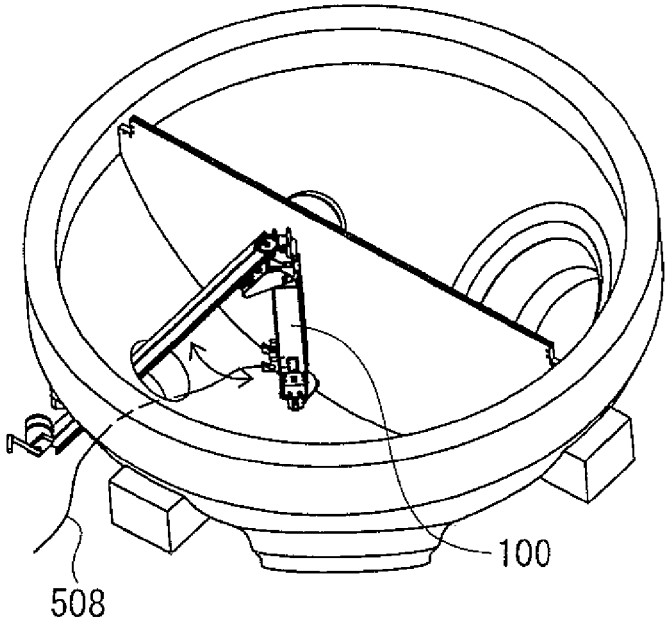
FIG. 12 is an explanation drawing showing the method for bringing the swivel support portion into the water chamber.

Once the swivel support portion 100 completely enters the water chamber 3*b*, the wire 508 is loosened. By so doing, the swivel support portion 100 has its upper part held by the trolley 503, hanging down in a vertical direction, as shown in FIG. 12.

Figure 13:
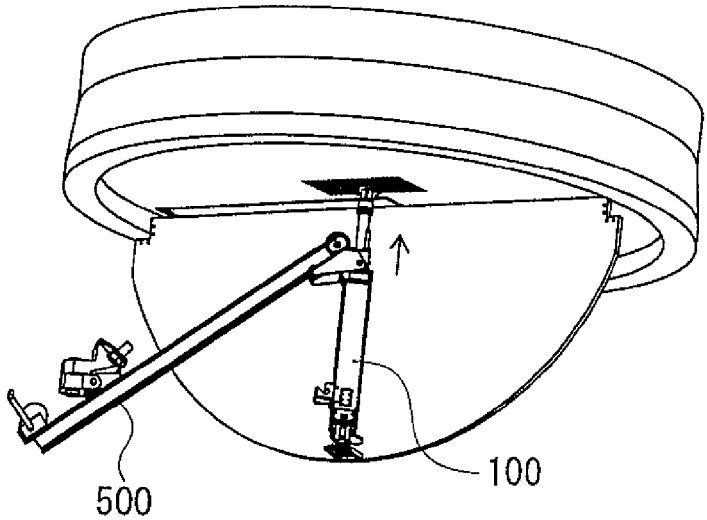
FIG. 13 is an explanation drawing showing the method for bringing the swivel support portion into the water chamber.

As shown in FIG. 13, the lower base 110 of the swivel support portion 100 is landed, and the upper support portion 130 is raised. The upper support portion 130 is pressed against the ceiling surface of the water chamber 3*b* to insert the engaging pins 133 into the heat transfer tubes.

At this time, the wire 507 is operated to adjust the position of the engaging pins 133 mounted on the upper support portion 130.

Figure 14:
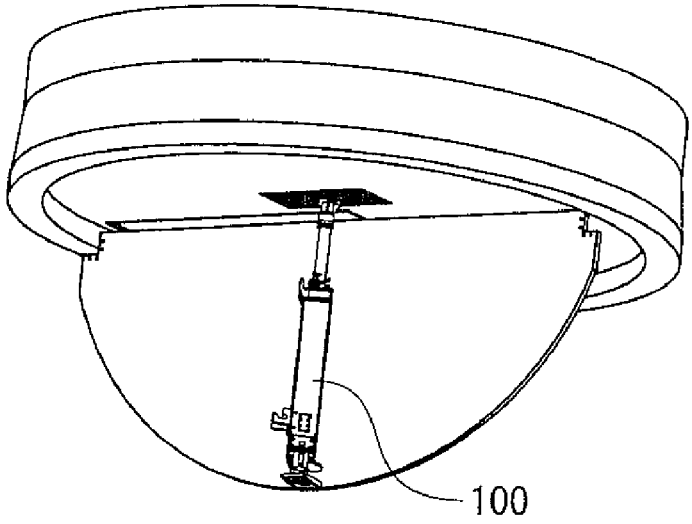
FIG. 14 is an explanation drawing showing the method for bringing the swivel support portion into the water chamber.

When the swivel support portion 100 stands by itself within the water chamber 3*b* in the above manner, as shown in FIG. 14, the pan/tilt mechanism 502 is operated to detach the carry-in rail device 500. In the operation performed up to this point in time, the operator does not enter the water chamber 3*b*.

Figure 15:
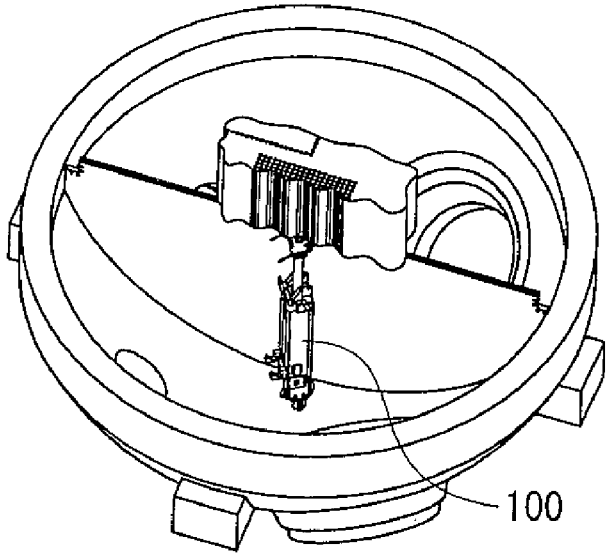
FIG. 15 is an explanation drawing showing a method for bringing a slide table into the water chamber.
Figure 16:
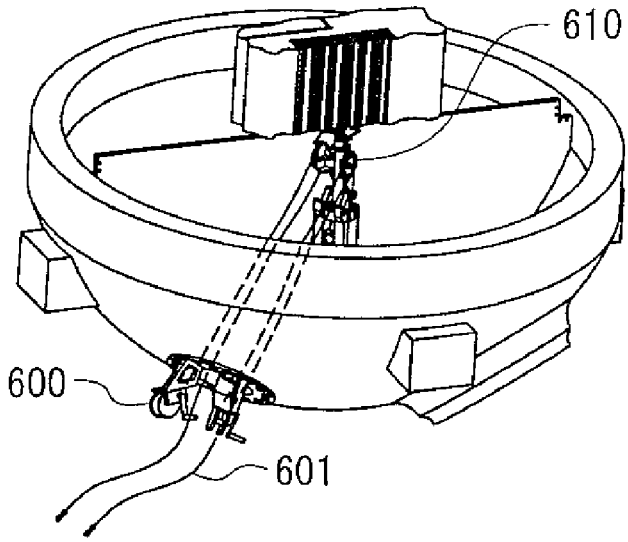
FIGS. 16(*a*) and 16(*b*) are explanation drawings showing the method for bringing the slide table into the water chamber.
Figure 16:
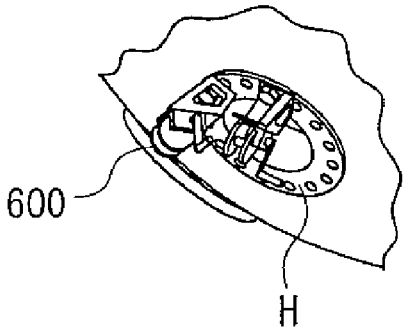
Figure 17:
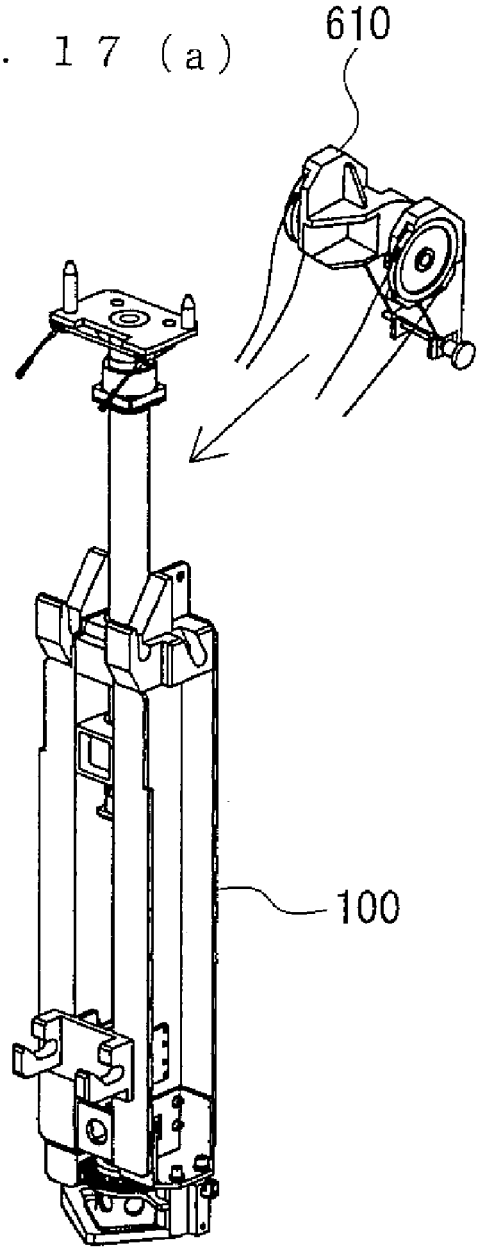
FIGS. 17(*a*) and 17(*b*) are explanation drawings showing the method for bringing the slide table into the water chamber.
Figure 17:
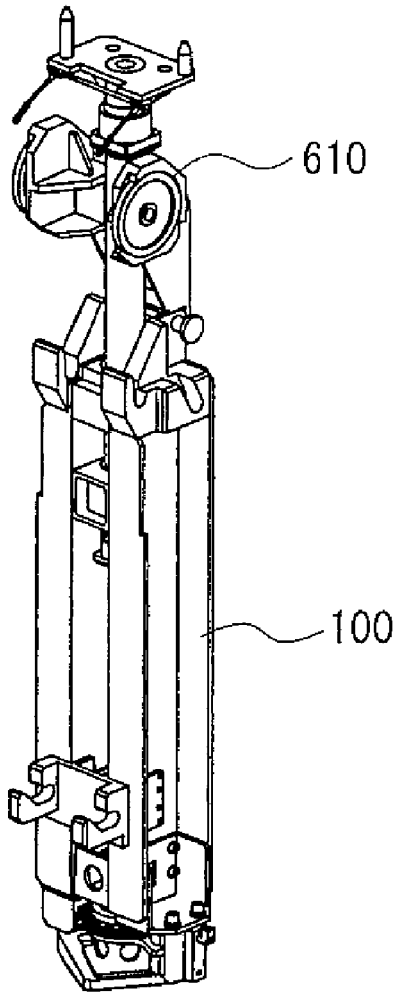

In the above manner, the swivel support portion 100 is fixed in a self-supporting manner within the water chamber 3*b*, as shown in FIG. 15. Then, as shown in FIGS. 16(*a*) and 16(*b*), a windup winch 600 is mounted on the manhole H, and the operator enters the water chamber 3*b*, and mounts a sheave rest 610 on the upper part of the swivel support portion 100. FIGS. 17(*a*) and 17(*b*) show the state of mounting of the sheave rest 610.

A wire 601 paid off from the windup winch 600 is passed over the sheave rest 610, then reversed, and led out of the manhole H. Mounting of the sheave rest 610 is completed in this manner, whereafter the operator quickly goes out of the water chamber 3*b*.

Figure 18:
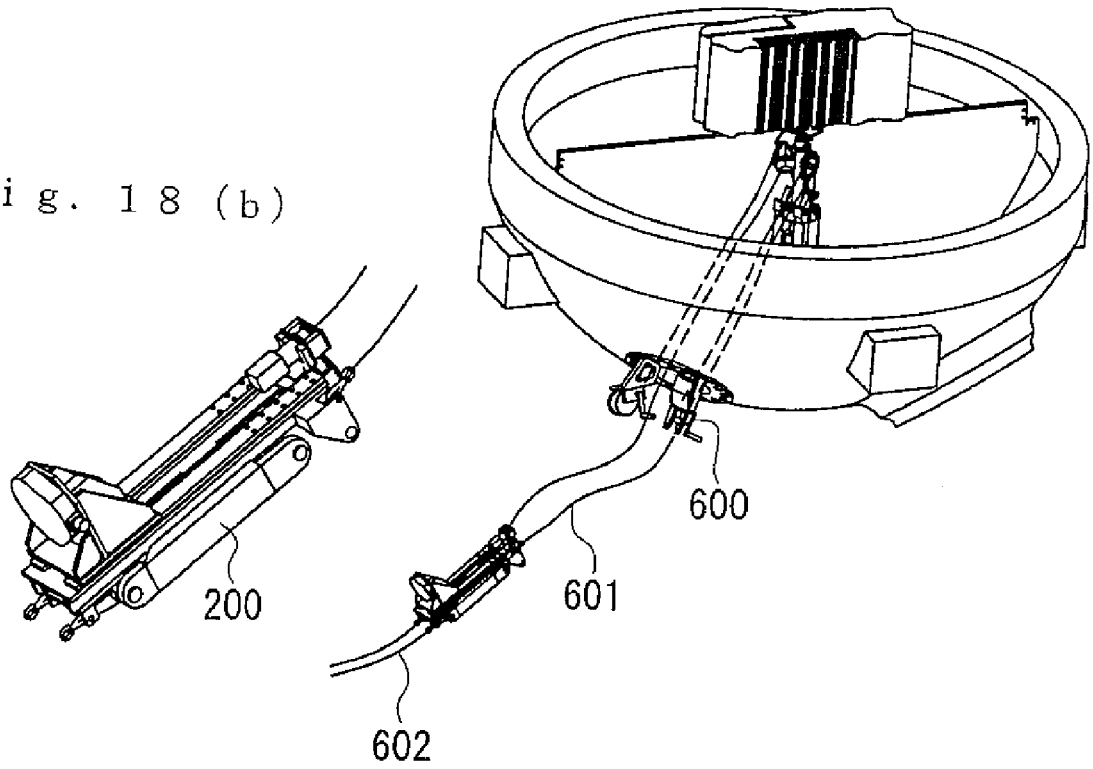
FIGS. 18(*a*) and 18(*b*) are explanation drawings showing the method for bringing the slide table into the water chamber.

As shown in FIGS. 18(*a*) and 18(*b*), the leading end of the wire 601 is tied to the leading end of the slide table 200. A wire 602 is tied to the rear end of the slide table 200.

Figure 19:
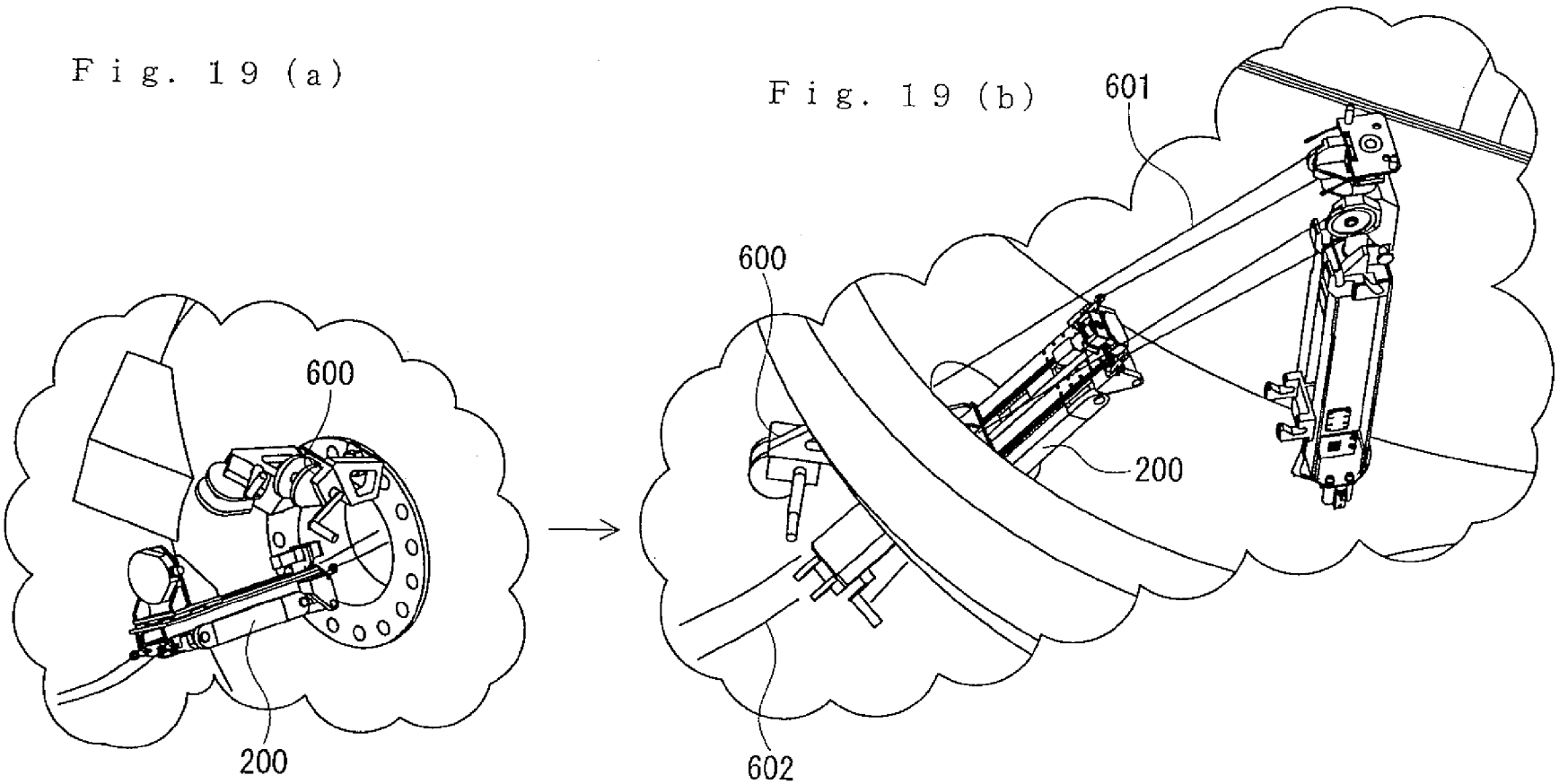
FIGS. 19(*a*) and 19(*b*) are explanation drawings showing the method for bringing the slide table into the water chamber.

As shown in FIGS. 19(*a*) and 19(*b*), the wire 601 is wound up by the windup winch 600, and back tension is applied by the wire 602, whereby the slide table 200 is carried into the water chamber 3*b*.

Figure 20:
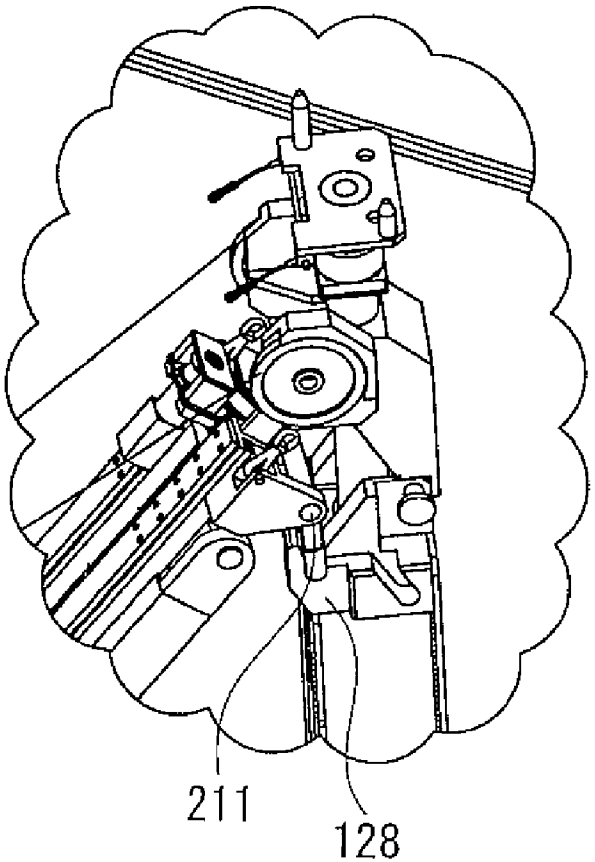
FIGS. 20(*a*) and 20(*b*) are explanation drawings showing the method for bringing the slide table into the water chamber.
Figure 20:
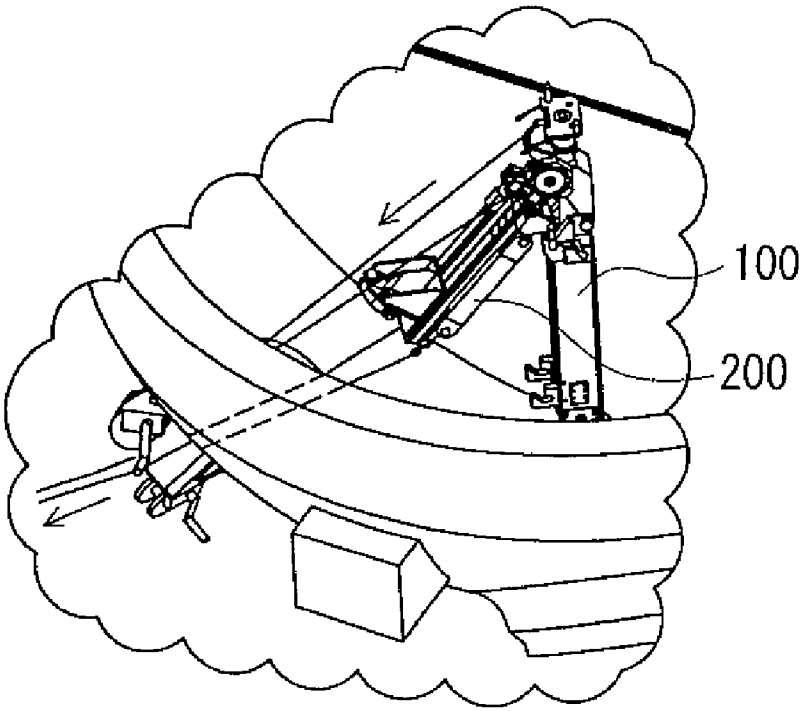

As shown in FIGS. 20(*a*) and 20(*b*), the slide table 200 is lifted so that the engaging pin 211 of the slide table 200 is situated above the engaging hook 128 of the swivel support portion 100 (see FIG. 6).

As shown in FIGS. 21(*a*) and 21(*b*), the wire 602 is loosened, and the wire 601 is gradually paid off from the windup winch 600. During this process, the engaging pin 211 of the slide table 200 moves downwardly and engages the engaging hook 128 of the swivel support portion 100.

As shown in FIG. 22, the wires 601 and 602 are both loosened, and the windup winch 600 is detached.

Figure 23:
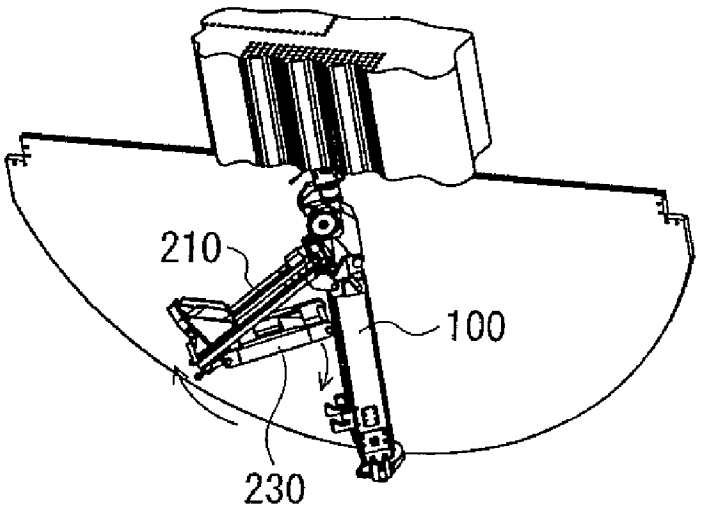
FIGS. 23(*a*) and 23(*b*) are explanation drawings showing the state of connection of the slide table.
Figure 23:
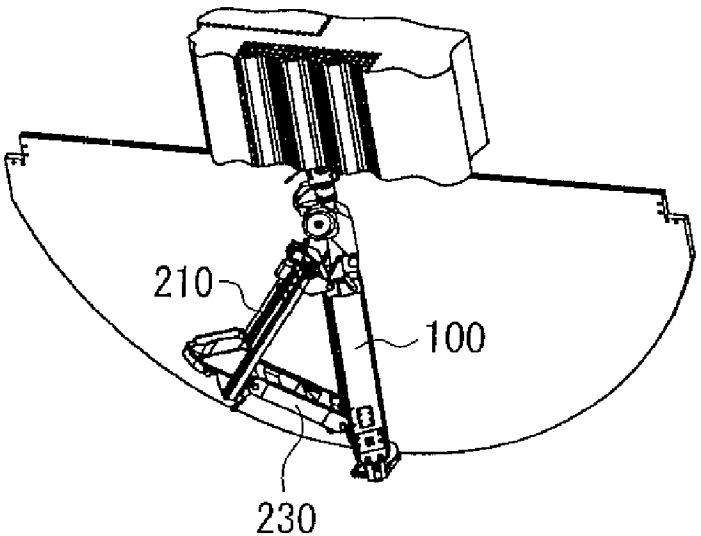

Then, the operator enters the water chamber 3*b*, and locks the slide table 200 to the swivel support portion 100 by the toggle clamp 129 (see FIG. 6). As shown in FIGS. 23(*a*) and 23(*b*), the lower end of the table portion 210 of the slide table 200 is separated from the swivel support portion 100 to increase the spacing between the lower end of the table portion 210 and the swivel support portion 100 (see FIG. 23(*a*)). The lower end of the support portion 230 is pivotally supported by the lower end of the swivel support portion 100, and fixed by a toggle clamp (not shown) in the same manner as for the upper part of the swivel portion 120 (FIG. 23(*b*)). Once this state is realized, the operator goes out of the water chamber 3*b*.

Figure 24:
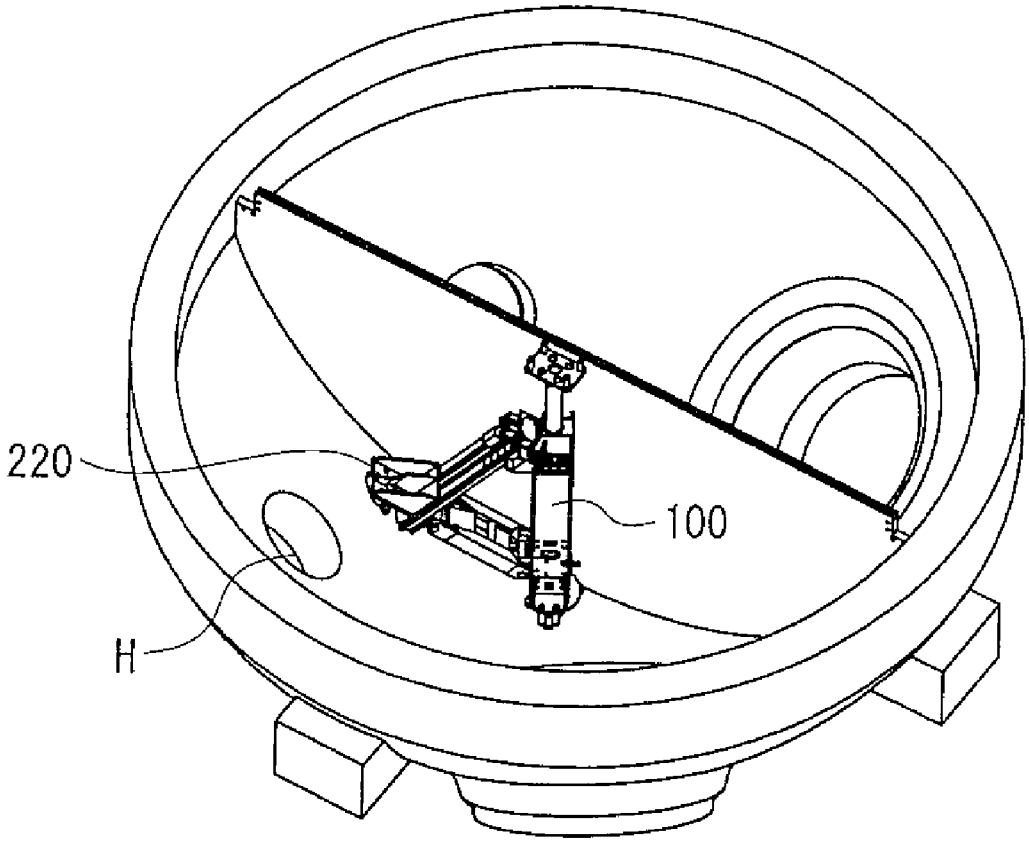
FIG. 24 is an explanation drawing showing the state of connection of the slide table.

As shown in FIG. 24, the swivel portion 120 of the swivel support portion 100 is swung to bring the tool changer 221 of the slide portion 220 to a position where the tool changer 221 faces the manhole H.

Figure 25:
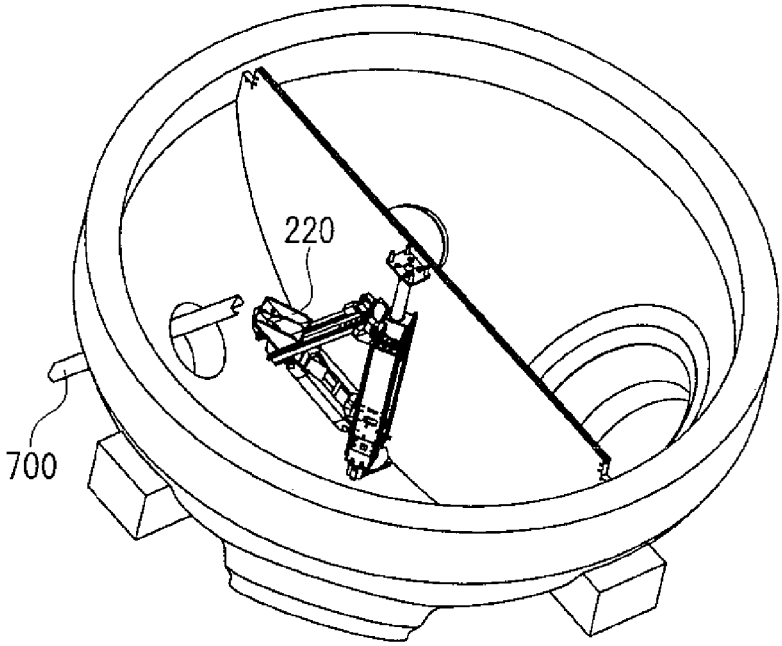
FIGS. 25(*a*) to 25(*c*) are explanation drawings showing a method for bringing a manipulator into the water chamber.
Figure 25:
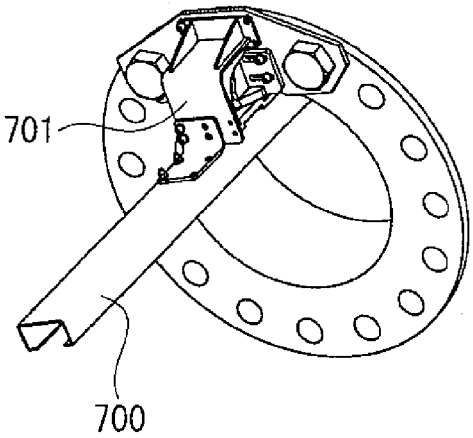
Figure 25:
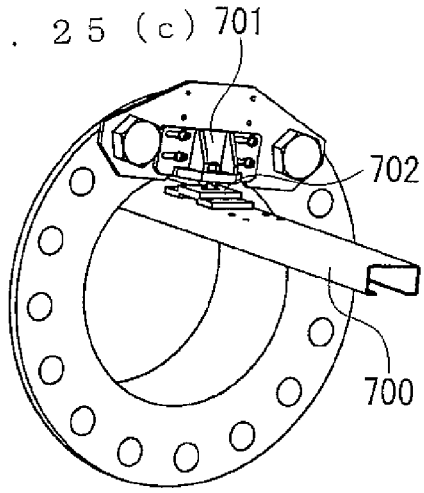

As shown in FIGS. 25(*a*), 25(*b*) and 25(*c*), an introducing rail 700 is attached to the manhole H via a bracket 701. The bracket 701 has a ball joint 702 built therein, and thus can adjust the direction of the introducing rail 700.

Figure 26:
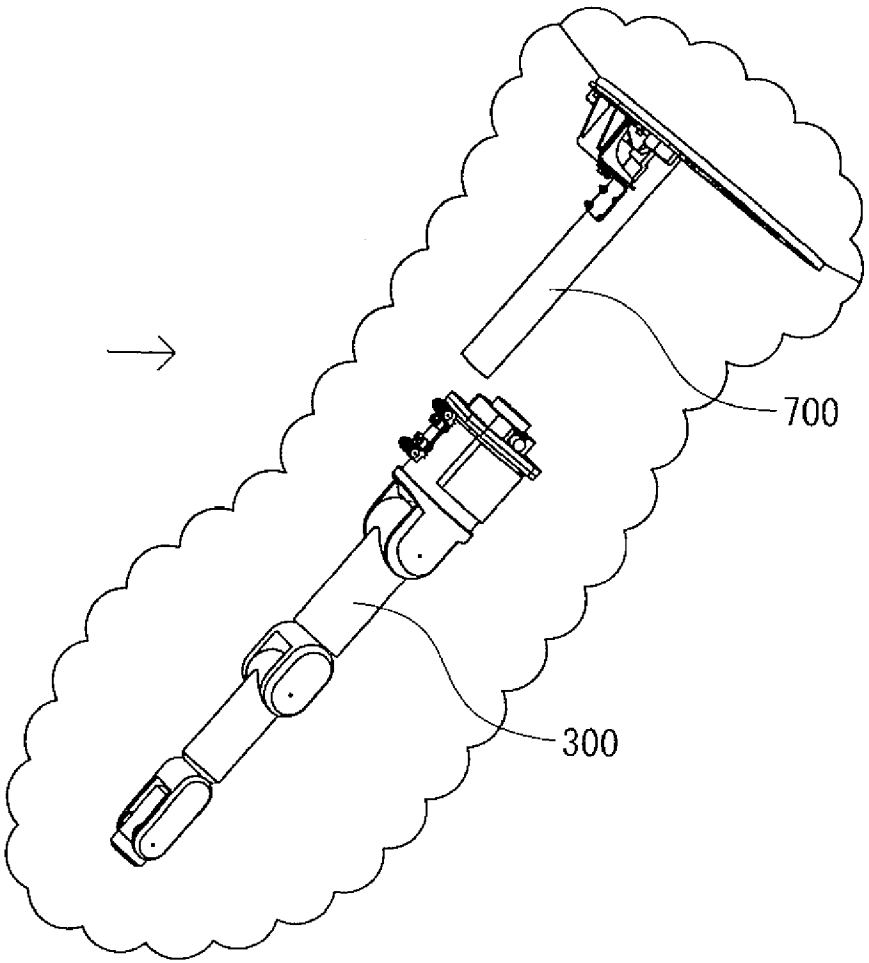
FIGS. 26(*a*) and 26(*b*) are explanation drawings showing the method for bringing the manipulator into the water chamber.
Figure 26:
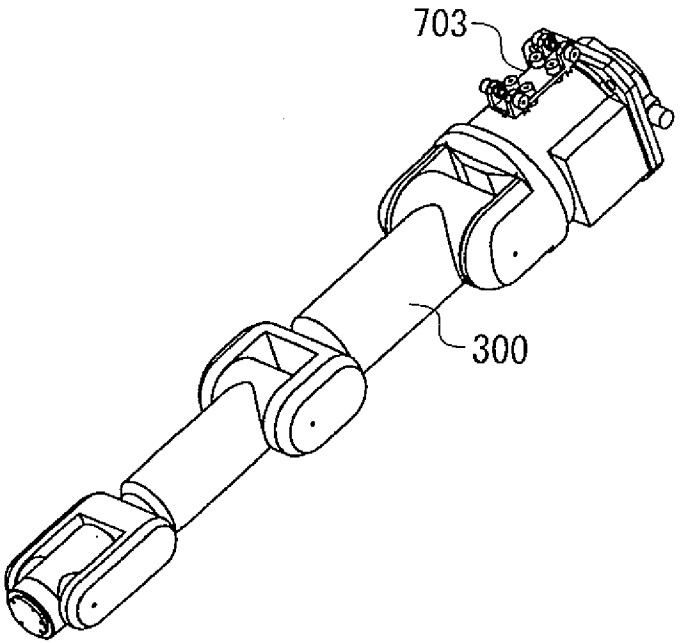

As shown in FIGS. 26(*a*) and 26(*b*), a guide roller 703 is attached to the manipulator 300, and the guide roller 703 is slid along the introducing rail 700. That is, the operator grasps the leading end of the manipulator 300 outside the water chamber 3*b*, and inserts the manipulator 300 into the water chamber 3*b*, with the proximal end side of the manipulator 300 being directed forward.

Figure 27:
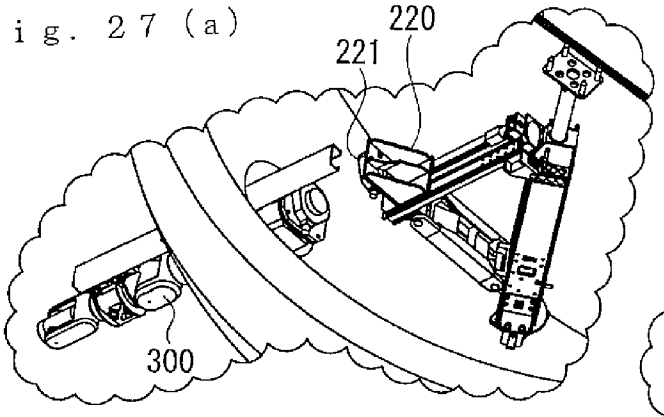
FIGS. 27(*a*) to 27(*c*) are explanation drawings showing the method for bringing the manipulator into the water chamber.
Figure 27:
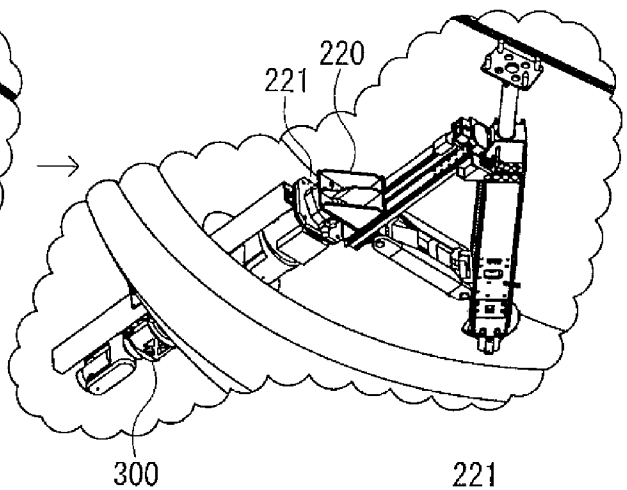
Figure 27:
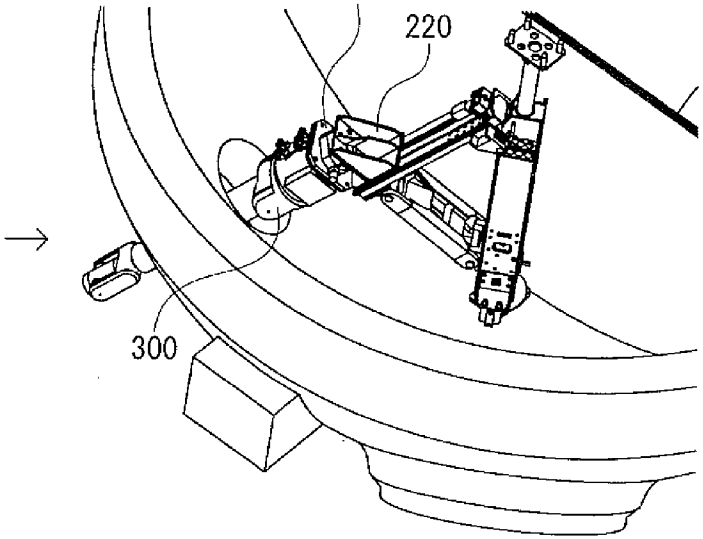

As a result, the proximal end of the manipulator 300 is grasped by the tool changer 221 of the slide portion 220, as shown in FIGS. 27(*a*), 27(*b*) and 27(*c*). Upon completion of grasping, the introducing rail 700 is detached.

Then, the slide portion 220 is pulled back rearward, and the manipulator 300 is operated to be pulled into the water chamber 3*b*.

In this manner, the swivel support portion 100, the slide table 200, and the manipulator 300 are brought into the water chamber 3*b*, so that the tip tool guide apparatus 1000 can be assembled within the water chamber 3*b*.

The tip tool guide apparatus 1000 is brought out of the water chamber by a procedure reverse to that for the above-described carry-in operation.

Embodiment 3

Next, another procedure for bringing the above-mentioned tip tool guide apparatus 1000 into the water chamber will be explained as Embodiment 3.

Figure 28:
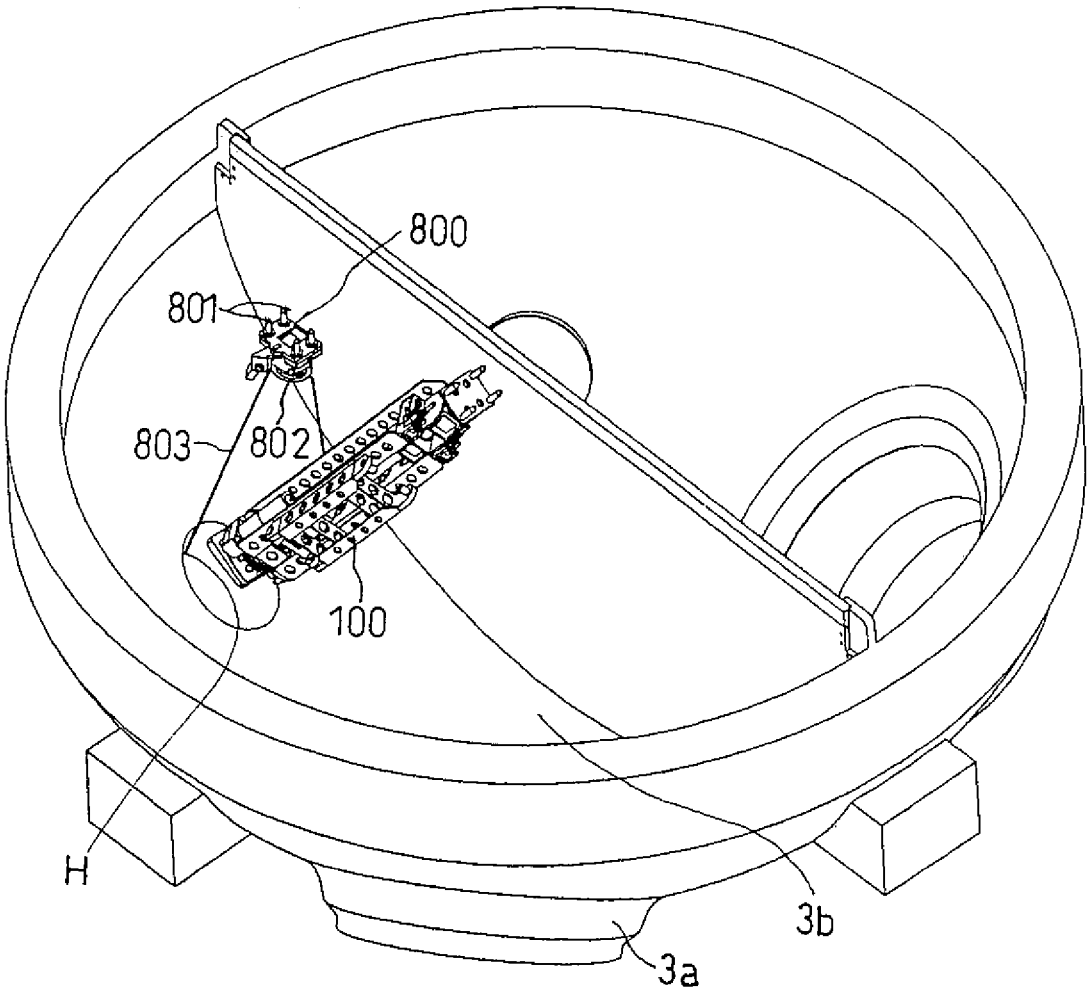
FIG. 28 is an explanation drawing showing a method for bringing the swivel support portion into the water chamber.

As shown in FIG. 28, a sheave device 800 is fixed to the ceiling surface of the water chamber 3*b*. This fixing is performed by inserting pins 801 of the sheave device 800 into the heat transfer tubes, and opening the pins 801 toward the outer periphery side (inflating the pins 801). A wire 803 is passed over a sheave 802 of the sheave device 800.

The leading end of the wire 803 is tied to the leading end of the swivel support portion 100, and the trailing end of the wire 803 is withdrawn out of the water chamber 3*b* through the manhole H. The trailing end side of the wire 803 is pulled by a winch or the like (not shown), whereby the swivel support portion 160 is brought into the water chamber 3*b*.

Figure 29:
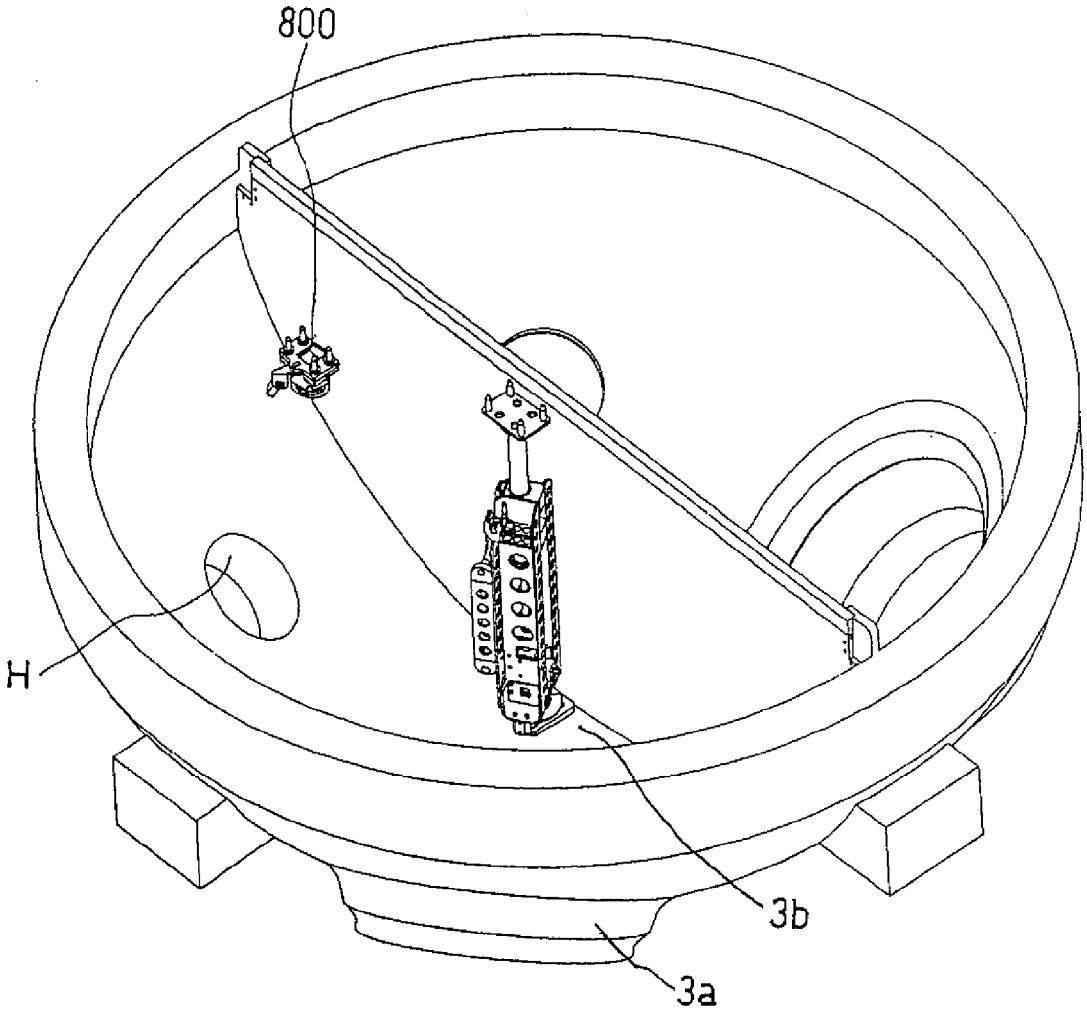
FIG. 29 is an explanation drawing showing the method for bringing the swivel support portion into the water chamber.

As shown in FIG. 29, the swivel support portion 100 brought into the water chamber 3*b* is self-supported and fixed within the water chamber 3*b*.

Figure 30:
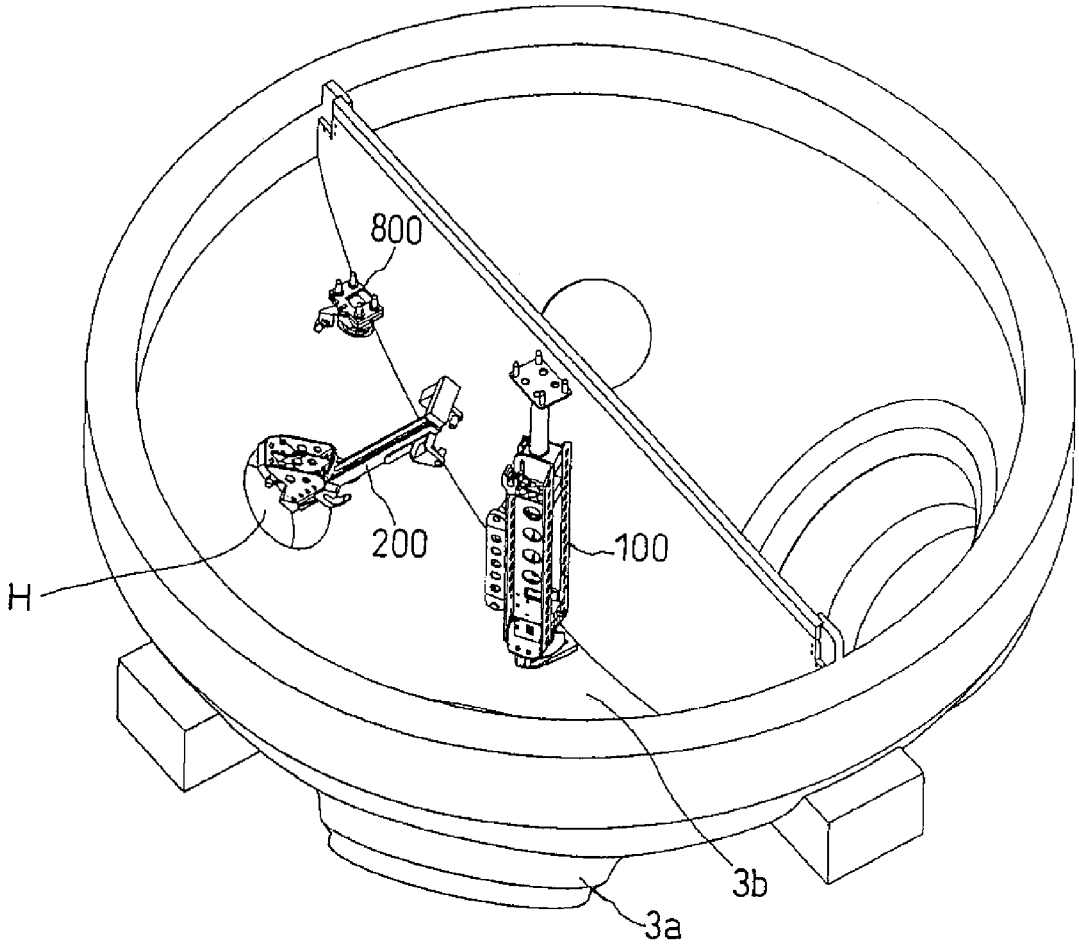
FIG. 30 is an explanation drawing showing a method for bringing the slide table into the water chamber.
Figure 31:
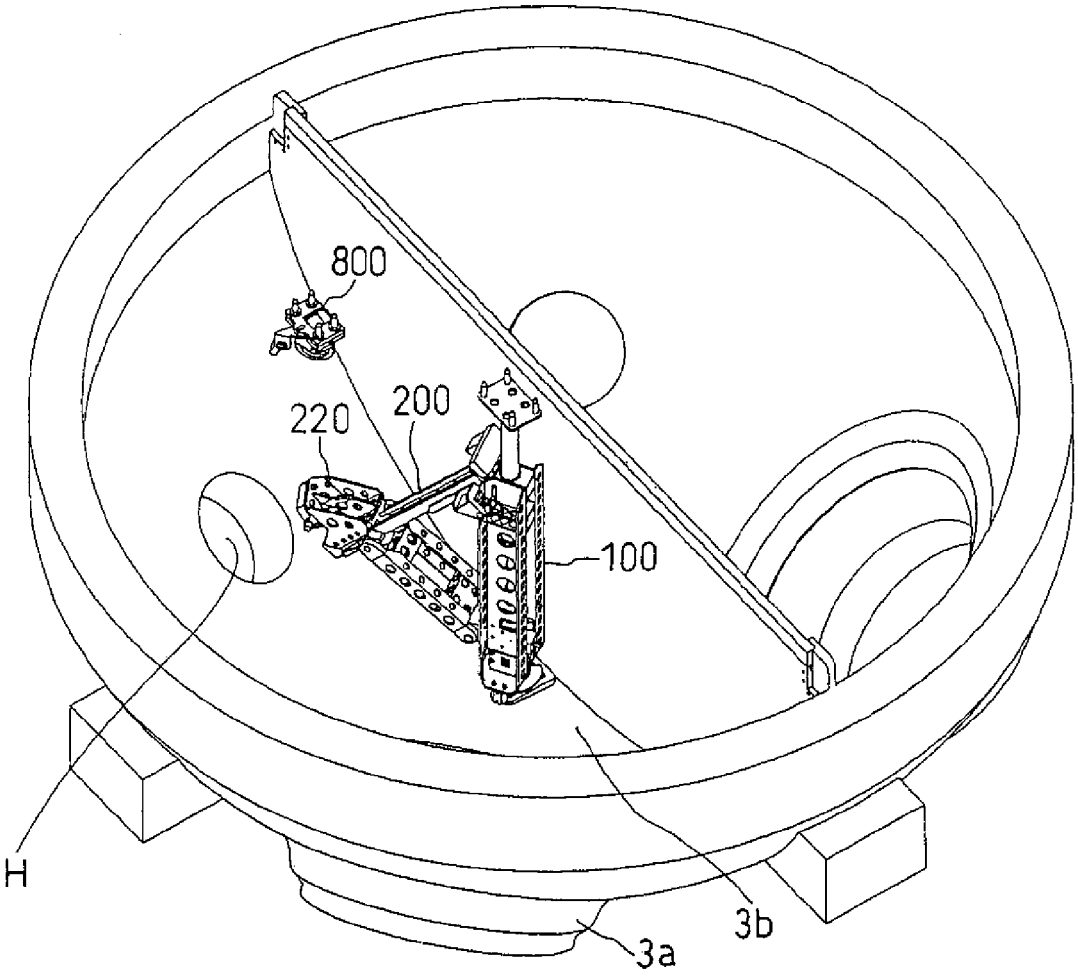
FIG. 31 is an explanation drawing showing the state of connection of the slide table.

As shown in FIG. 30, the slide table 200 is brought into the water chamber 3*b* through the manhole H and, as shown in FIG. 31, the slide table 200 is connected to the swivel support portion 100. Then, the slide portion 220 of the slide table 200 is brought into face-to-face relationship with the manhole H.

Figure 32:
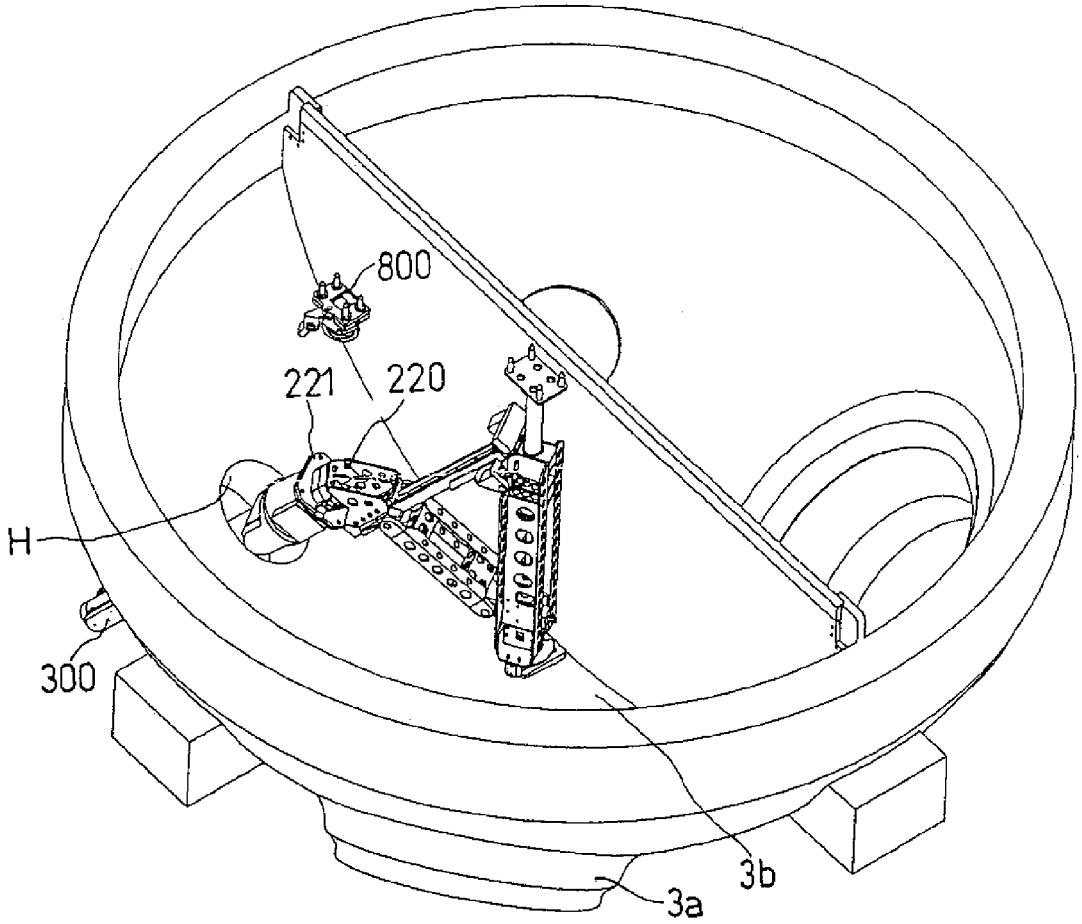
FIG. 32 is an explanation drawing showing a method for bringing the manipulator into the water chamber.

As shown in FIG. 32, the manipulator 300 is inserted into the water chamber 3*b*, with the rear end side of the manipulator 300 being directed forward, and the rear end of the manipulator 300 is grasped by the tool changer 221 of the slide portion 220.

Figure 33:
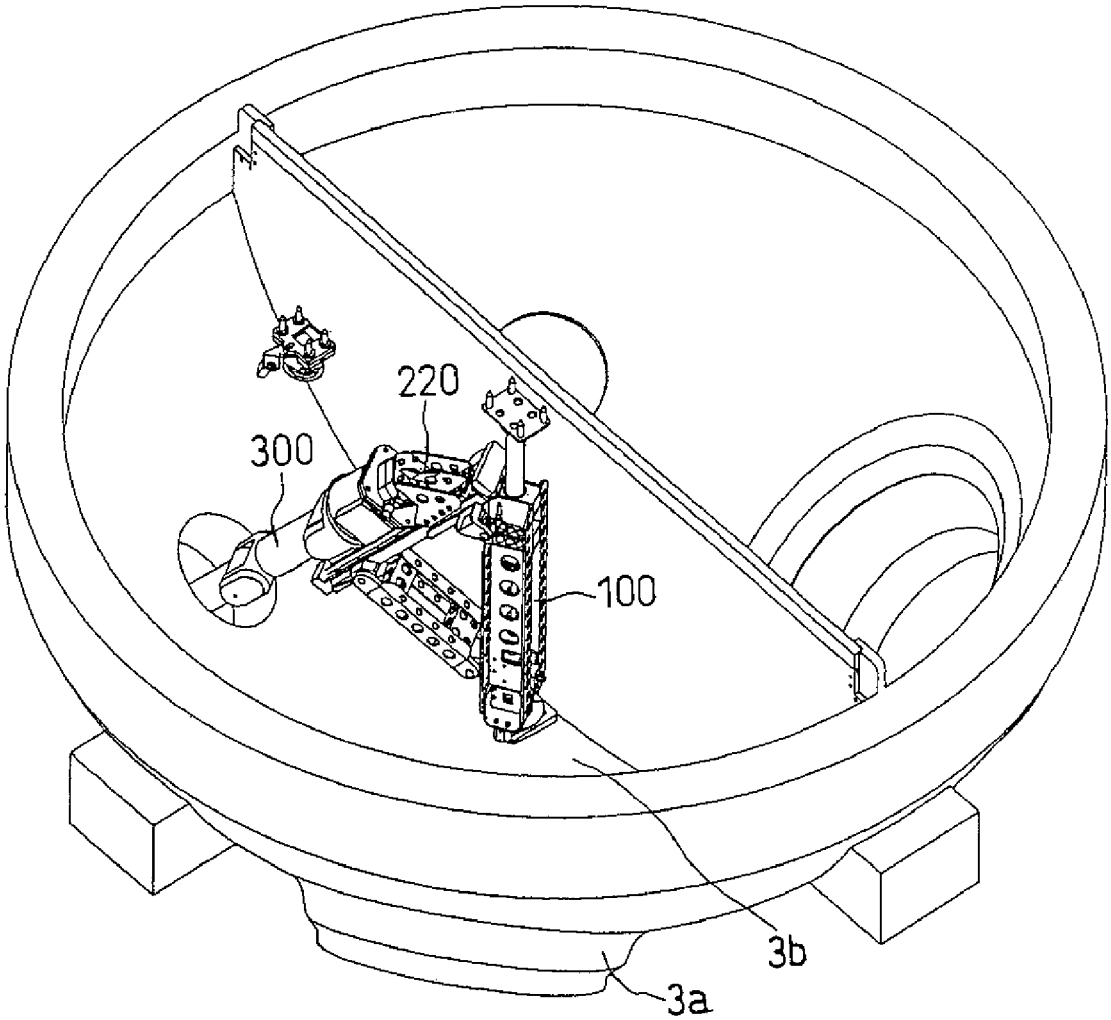
FIG. 33 is an explanation drawing showing the method for bringing the manipulator into the water chamber.

Then, as shown in FIG. 33, the slide portion 220 is retracted rearward to pull the manipulator 300 into the water chamber 3*b*.

Figure 34:
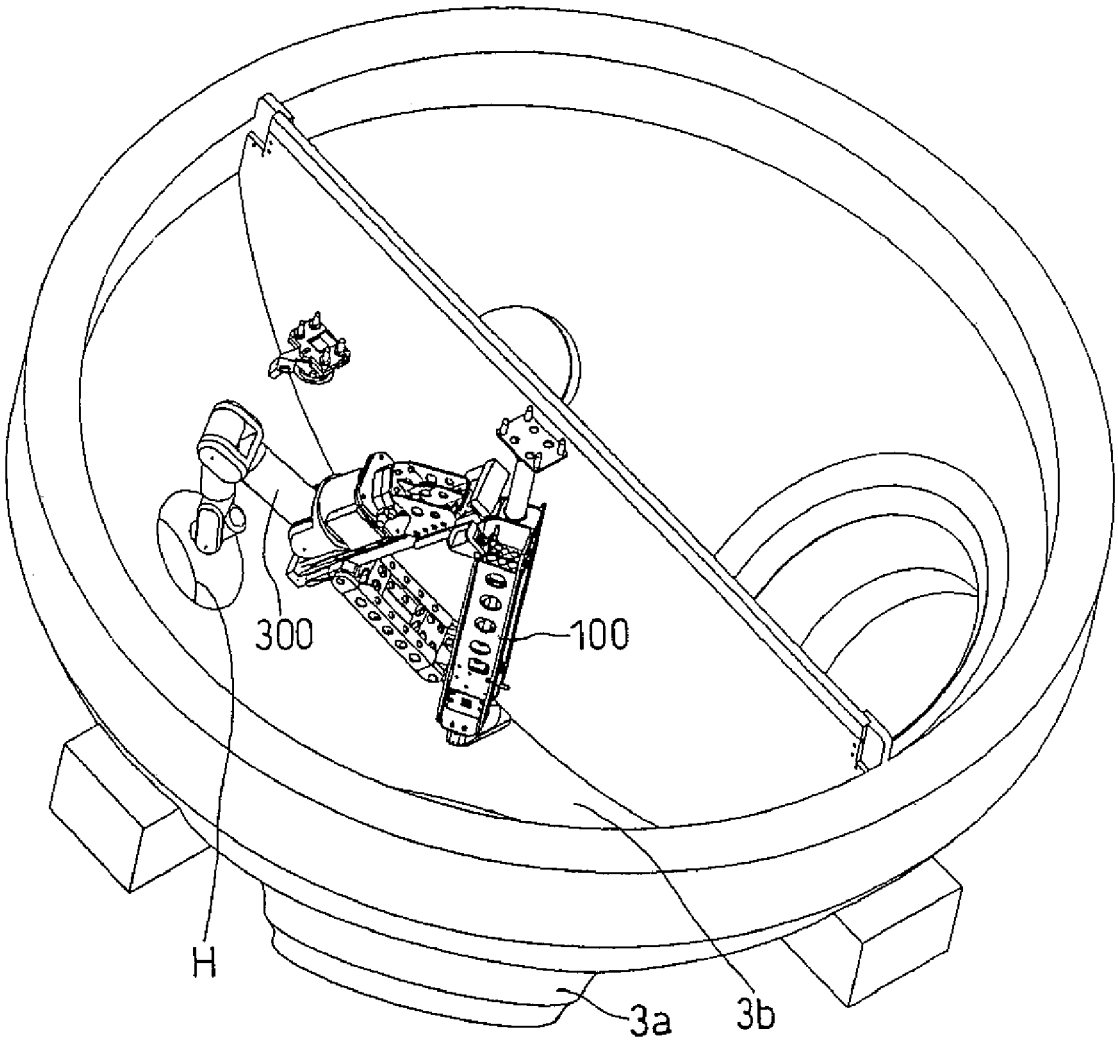
FIG. 34 is an explanation drawing showing the method for bringing the manipulator into the water chamber.
Figure 35:
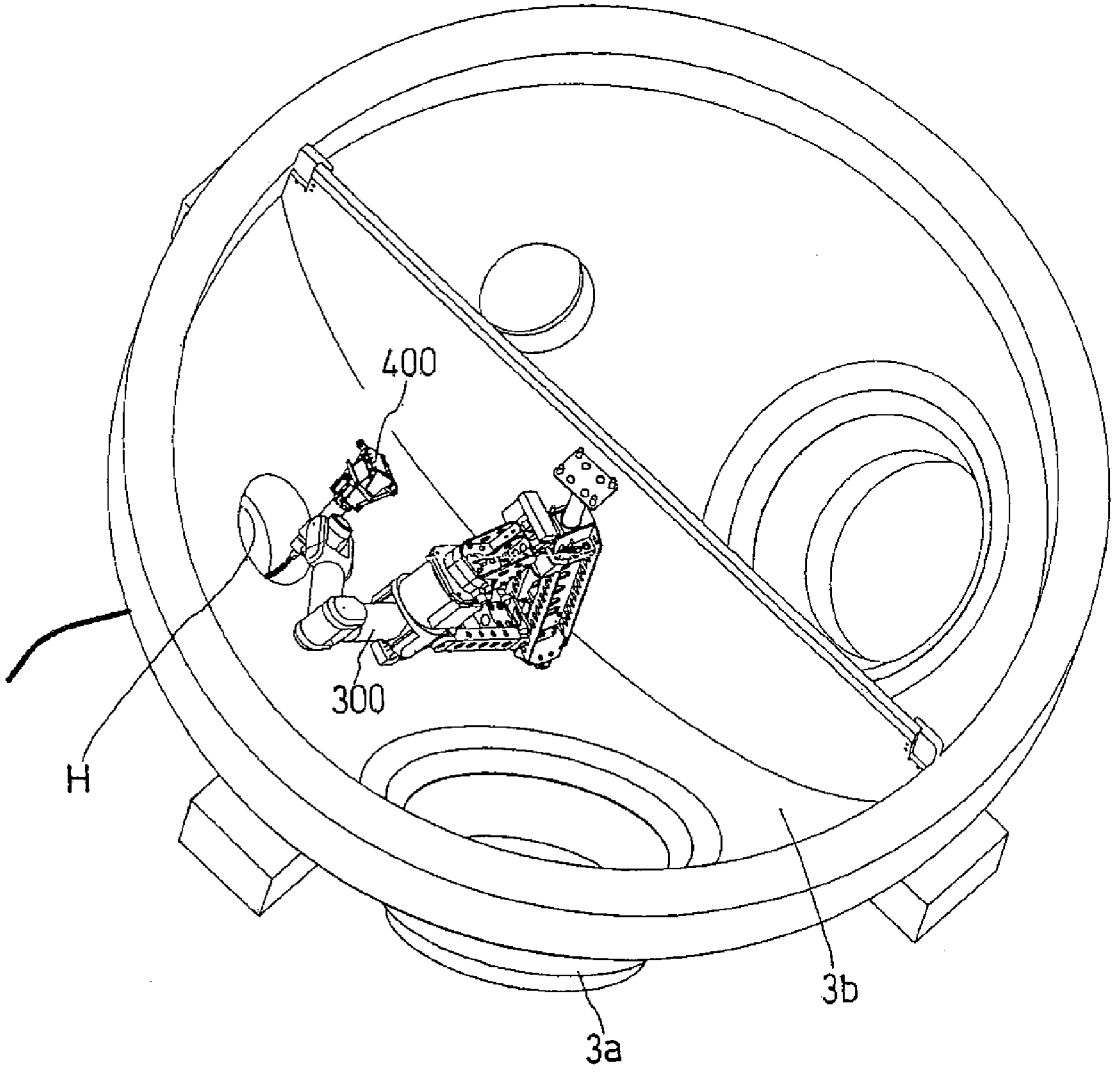
FIG. 35 is an explanation drawing showing the method for bringing the manipulator into the water chamber.

Then, like Embodiments 1 and 2, the whole of the manipulator 300 is led into the water chamber 3*b* such that the arm of the manipulator 300 is bent, as shown in FIGS. 34 and 35.

In this manner, the swivel support portion 100, the slide table 200, and the manipulator 300 are brought into the water chamber 3*b*, and the tip tool guide apparatus 1000 can be assembled within the water chamber 3*b*.

Embodiment 4

Next, an explanation will be offered for a foreign matter entry preventing jig which is an accessory instrument convenient for use in performing shot peening.

Figure 36:
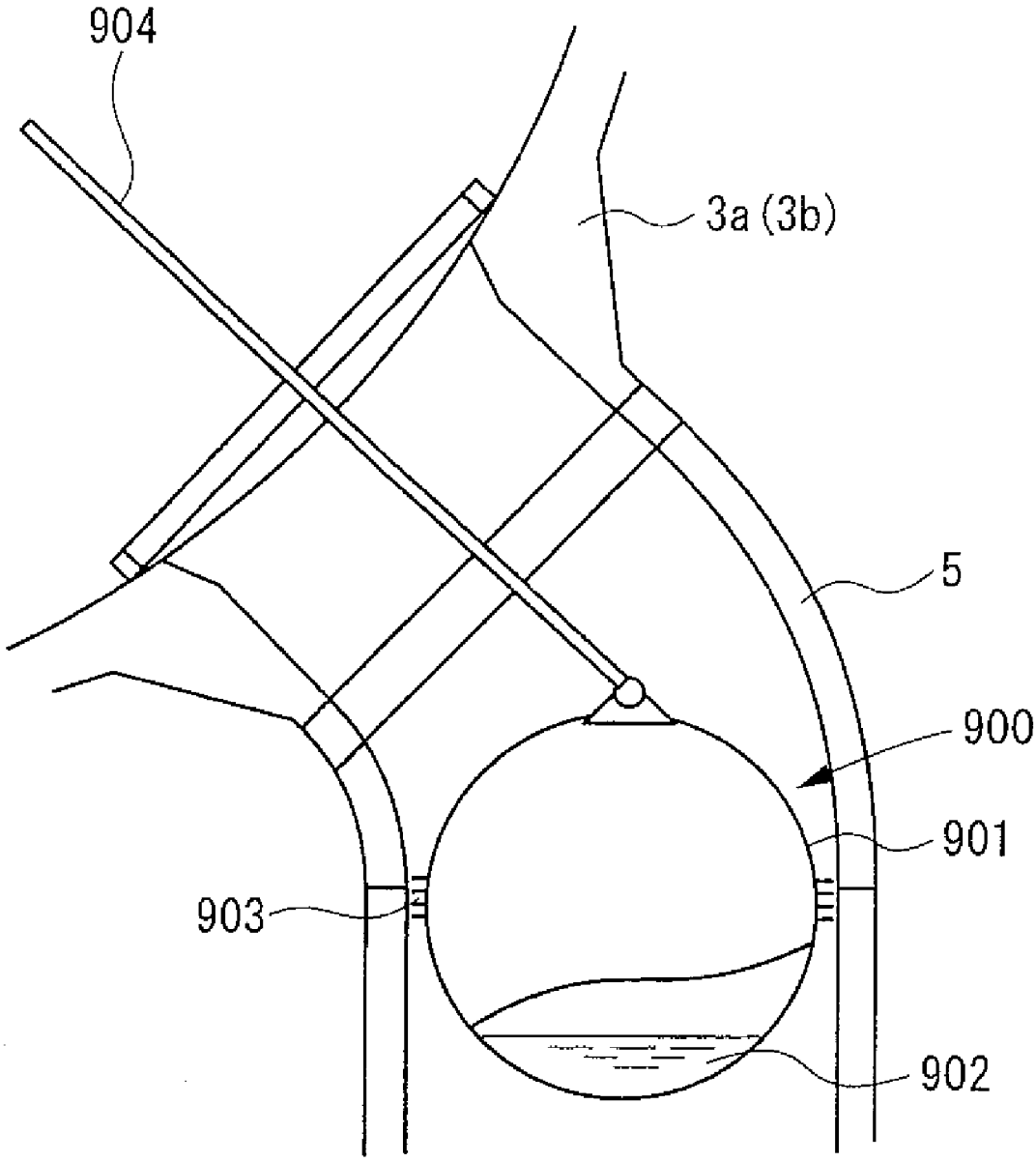
FIG. 36 is a configurational drawing showing a foreign matter entry preventing jig.

FIG. 36 shows a foreign matter entry preventing jig 900. The foreign matter entry preventing jig 900 comprises an expansible and contractible balloon 901 containing water 902, which serves as a weight for ensuring a posture; a seal 903 provided on the circumferential surface of the balloon 901; and an operating rod 904 provided pivotably at the top of the balloon 901. Furthermore, a hose for supplying water and air into the balloon 901 is provided within the operating rod 904. The seal 903 is disposed at a position corresponding to the equator of the balloon 901 when the foreign matter entry preventing jig 900 is disposed within the main coolant pipe 5, as shown in FIG. 36.

Figure 37:
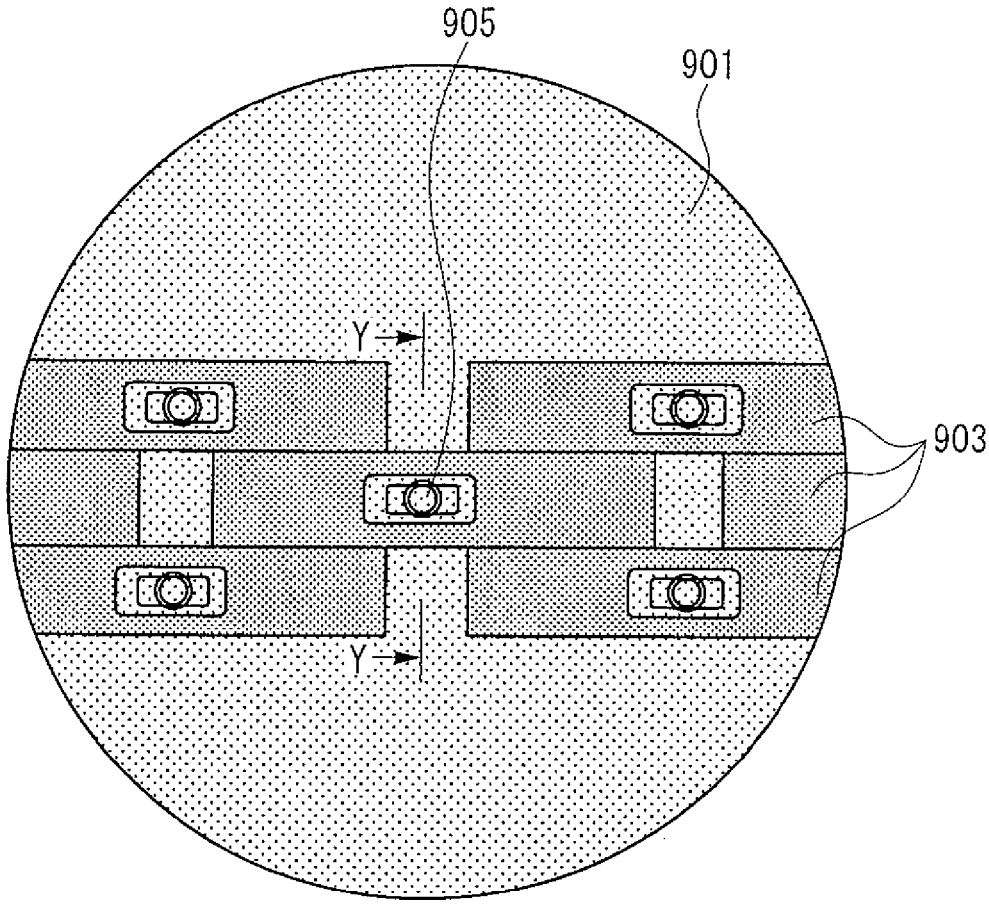
FIG. 37 is a configurational drawing showing the foreign matter entry preventing jig.
Figure 38:
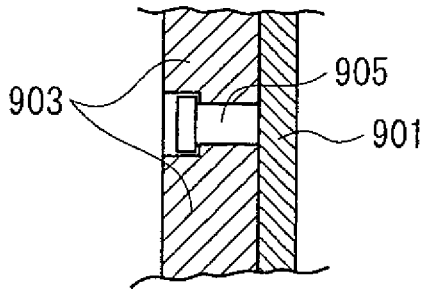
FIG. 38 is a configuration drawing showing a section along line Y-Y in FIG. 37.
Figure 39:
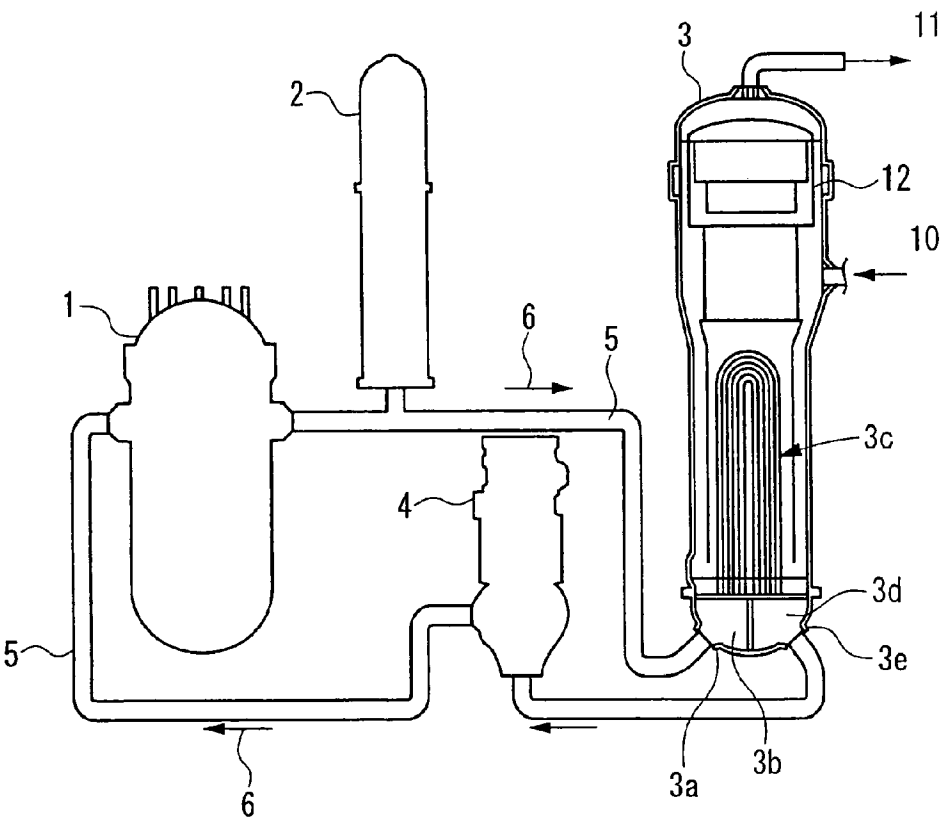
Fig. 39 Related Art
FIG. 39 is a configurational drawing showing a primary system of pressurized light water reactor nuclear power equipment.
Figure 40:
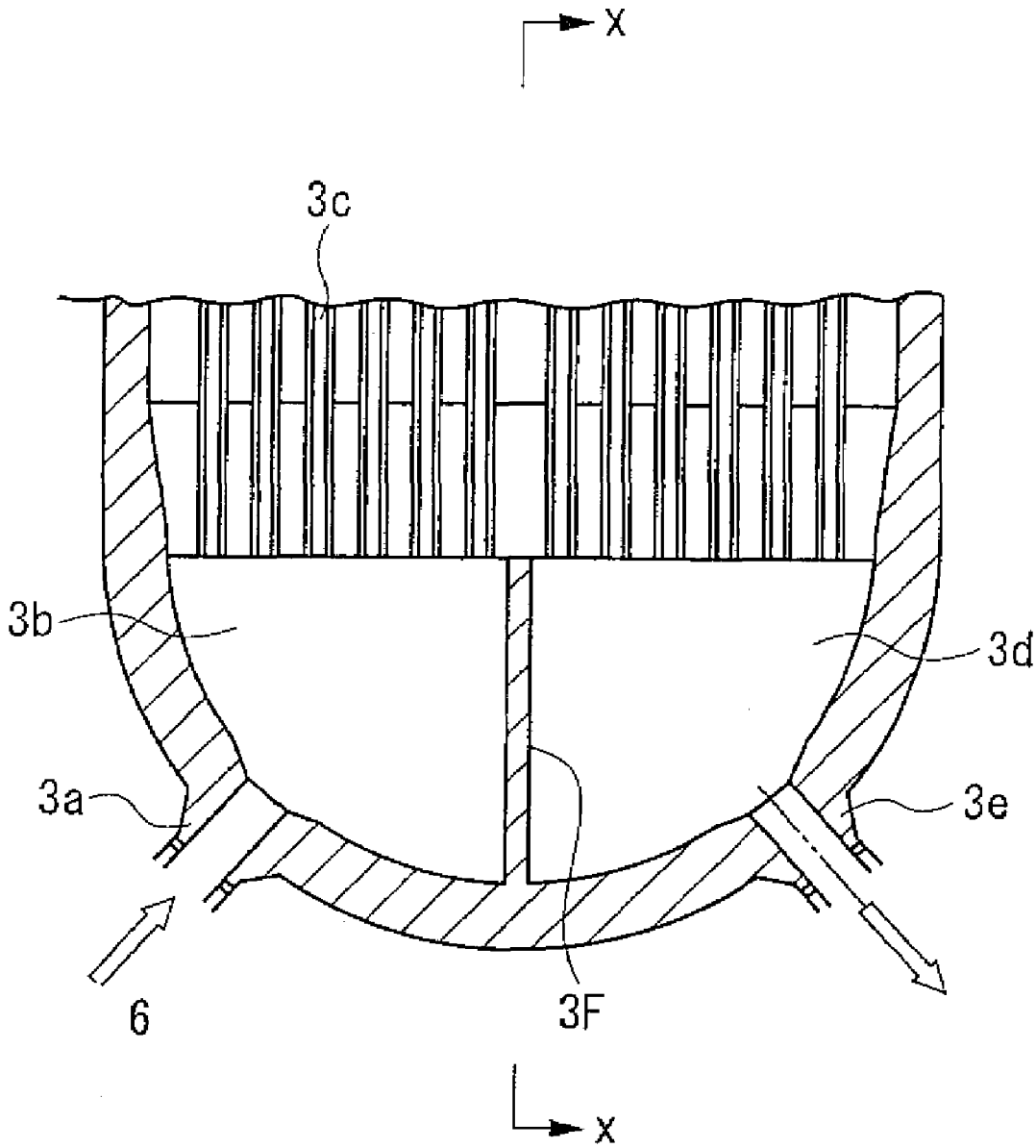
Fig. 40 Related Art
FIG. 40 is a configurational drawing showing a lower portion of a steam generator.
Figure 41:
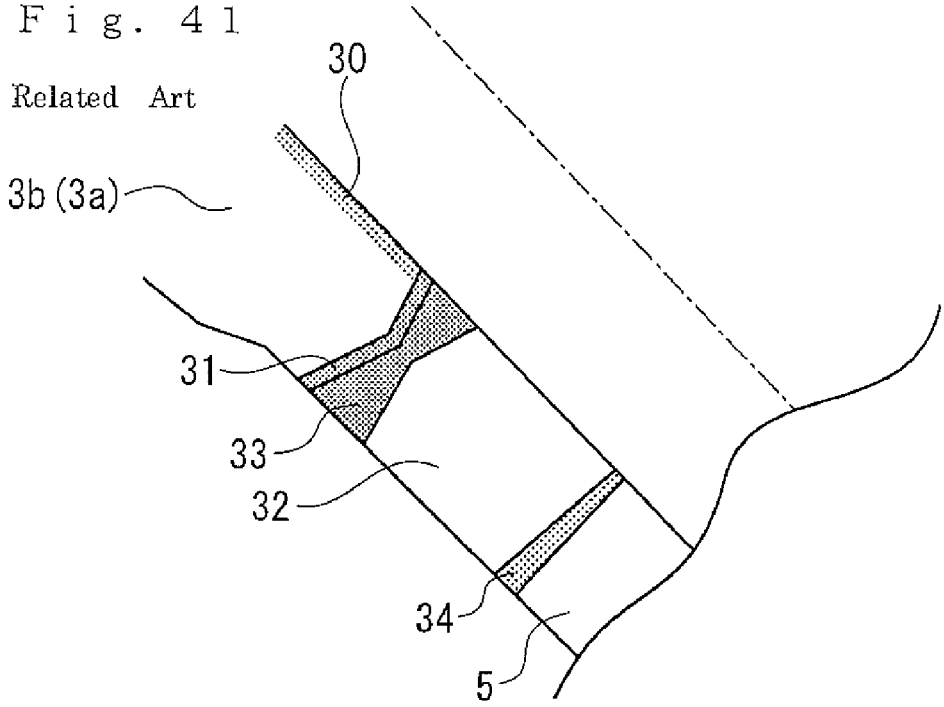
Fig. 41 Related Art
FIG. 41 is a configurational drawing showing a joint structure for joining a nozzle stub and a main coolant pipe.
Figure 42:
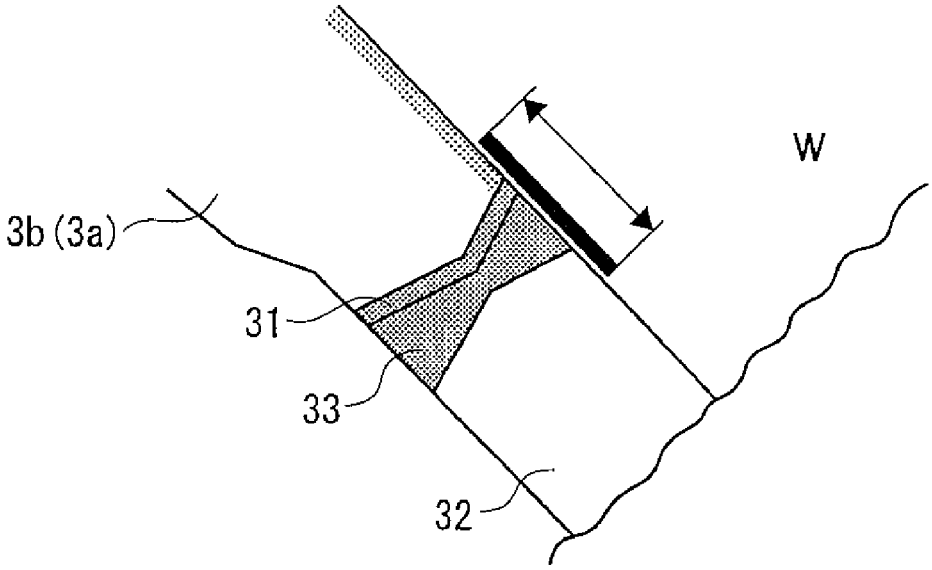
Fig. 42 Related Art
FIG. 42 is an explanation drawing showing a shot peening region.
Figure 43:
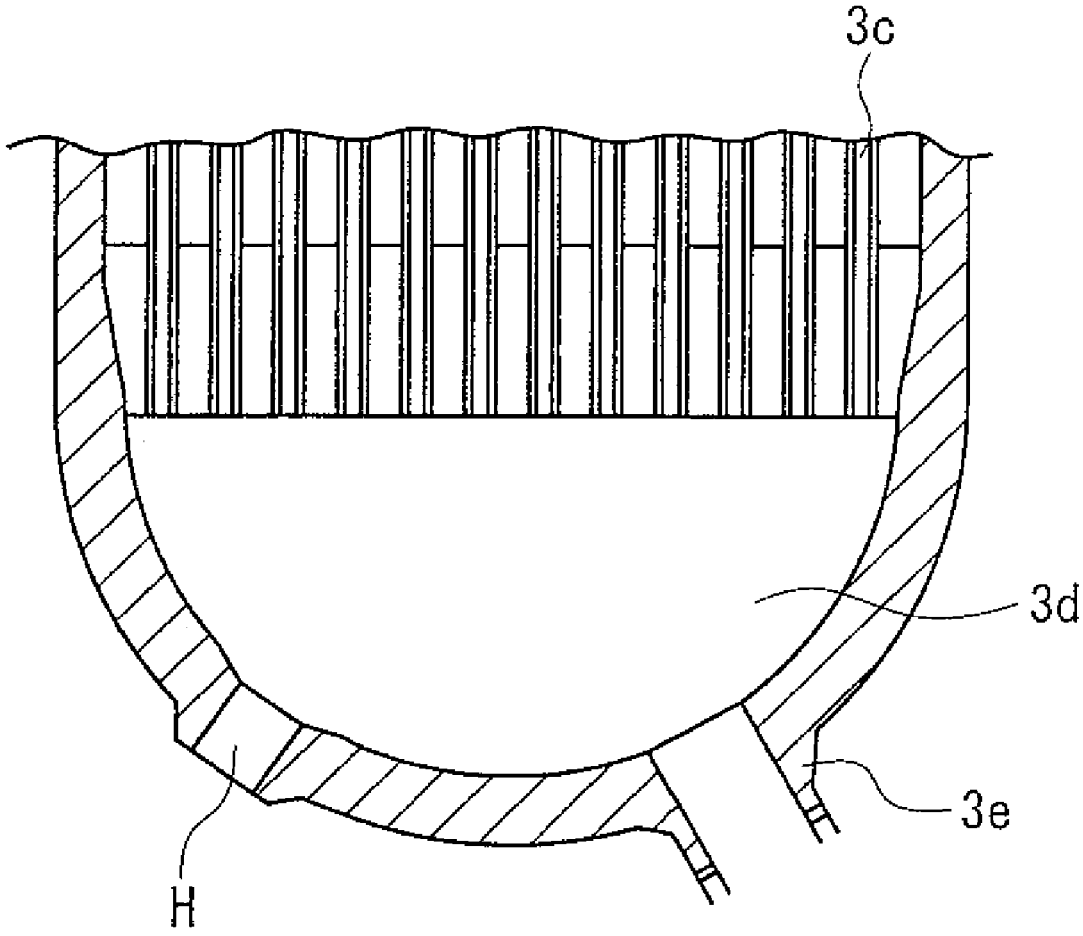
Fig. 43 Related Art
FIG. 43 is a configurational drawing showing a section along line X-X in FIG. 40.

Besides, as shown in FIG. 37 and FIG. 38 which shows a section along line Y-Y in FIG. 37, the seal 903 is supported by a stop member 905 such that the longitudinal direction of the seal 903 is along the circumferential direction of the balloon, and the seal 903 can slide in the circumferential direction. The seals 903 are arranged vertically in three stages in a staggered fashion.

Prior to shot peening by the aforementioned tip tool guide apparatus 1000, the foreign matter entry preventing jig 900 is inserted into the main coolant pipe 5 connected to the nozzle stub 3*a* (3*e*) to seal the main coolant pipe 5, as shown in FIG. 36.

Concretely, a deflated balloon 901 is placed within the main coolant pipe 5, and water and air are supplied into the deflated balloon 901 to inflate it, thereby bringing the seals 903 into close contact with the inner peripheral surface of the main coolant pipe 5. Moreover, a gap exists between the balloon 901 and the main coolant pipe 5, thus ensuring reliable collection of foreign matter.

By so sealing the main coolant pipe 5, foreign matter, if fallen during shot peening, is trapped by the foreign matter entry preventing jig 900, whereby the foreign matter can be prevented from entering deep into the main coolant pipe 5.

What is claimed is:

1. A tip tool guide apparatus which is brought into a water chamber of a steam generator of nuclear power equipment, and guides various tip tools, necessary to perform shot peening, along a processing region for shot peening, the tip tool guide apparatus comprising a swivel support portion, a slide table and a manipulator, the swivel support portion including a lower base which is to become a portion landing on a bottom surface of the water chamber, a swivel portion mounted swingably on the lower base so as to be capable of swiveling in a horizontal plane when standing in a vertical direction, an upper support portion which is provided to be movable upward and downward with respect to the lower base and abuts on a ceiling surface of the water chamber when ascending, and an elevating mechanism for raising and lowering the upper support portion, the slide table including a table portion, connecting means for connecting the table portion to the swivel portion detachably, and a slide portion which moves slidingly with respect to the table portion and supports a proximal end portion of the manipulator detachably, and the manipulator having at a leading end thereof a tool changer for supporting the tip tool detachably.

2. A method for bringing in a tip tool guide apparatus, which brings the tip tool guide apparatus into a water chamber of the steam generator via a manhole formed in the water chamber to perform shot peening, the tip tool guide apparatus comprising:

a swivel support portion, a slide table and a manipulator, the swivel support portion including a lower base which is to become a portion landing on a bottom surface of the water chamber, a swivel portion mounted swingably on the lower base so as to be capable of swiveling in a horizontal plane when standing in a vertical direction, an upper support portion which is provided to be movable upward and downward with respect to the lower base and abuts on a ceiling surface of the water chamber when ascending, and an elevating mechanism for raising and lowering the upper support portion, the slide table including a table portion, connecting means for connecting the table portion to the swivel portion detachably, and a slide portion which moves slidingly with respect to the table portion and supports a proximal end portion of the manipulator detachably, and the manipulator having at a leading end thereof a tool changer for supporting the tip tool detachably, the method comprising:

disposing a sheave, over which a wire is passed, within the water chamber, connecting one end side of the wire to the swivel support portion, withdrawing other end side of the wire out of the water chamber through the manhole, and pulling the wire outside the water chamber to bring the swivel support portion into the water chamber through the manhole;

landing the lower base of the swivel support portion, which has been brought into the water chamber, on a bottom surface of the water chamber, and pressing the upper support portion against a ceiling surface of the water chamber to render the swivel support portion self-supported;

disposing a sheave, over which a wire is passed, within the water chamber, connecting one end side of the wire to the slide table, withdrawing other end side of the wire out of the water chamber through the manhole, pulling the wire outside the water chamber to bring the slide table into the water chamber through the manhole, and connecting the slide table, which has been brought into the water chamber, to the swivel support portion via the connecting means;

turning the swivel portion of the swivel support portion, thereby causing the slide portion of the slide table to face the manhole; and inserting the manipulator into the water chamber via the manhole, with a proximal end portion of the manipulator being at a forefront, and connecting the proximal end portion of the manipulator to the slide portion.

* * * * *